US006745612B1

(12) United States Patent
McIlwraith

(10) Patent No.: US 6,745,612 B1
(45) Date of Patent: Jun. 8, 2004

(54) FULL-FRAME ANCHORING SYSTEM FOR VEHICLE COLLISION REPAIR

(75) Inventor: Lon William McIlwraith, Delta (CA)

(73) Assignee: 668201 B.C. Ltd, Delta (CA)

( * ) Notice: Subject to any disclaimer, the term of this patent is extended or adjusted under 35 U.S.C. 154(b) by 0 days.

(21) Appl. No.: 10/306,157

(22) Filed: Nov. 29, 2002

(51) Int. Cl.[7] ..... B21J 13/08
(52) U.S. Cl. ..... 72/457; 72/298; 72/705
(58) Field of Search ..... 72/298, 299, 457, 72/705; 269/75

(56) References Cited

U.S. PATENT DOCUMENTS 3,815,892 A * 6/1974 Tulk ..... 269/75
4,400,969 A * 8/1983 Specktor ..... 72/457
5,413,303 A * 5/1995 Lee ..... 248/354.1
5,596,900 A * 1/1997 Pietrelli ..... 72/457
5,634,368 A * 6/1997 Venalainen ..... 72/457
5,916,322 A * 6/1999 Venalainen ..... 72/457
5,941,513 A * 8/1999 Moilanen et al. ..... 269/32

* cited by examiner

*Primary Examiner*—Ed Tolan
(74) *Attorney, Agent, or Firm*—Oyen Wiggs Green & Mutala

(57) ABSTRACT

A vehicle clamp assembly has an upper end releasably clampable to a vehicle frame member, and a lower end releasably attachable to a support frame. The assembly is rotatable about a first axis substantially parallel to the support frame and is also rotatable about a second axis substantially perpendicular to both the support frame and the first axis. The assembly's base can thus be levelled with respect to the support frame before the assembly is attached to the support frame. This allows the assembly to be clamped onto a vehicle frame member, irrespective of the frame member's orientation relative to the support frame.

23 Claims, 23 Drawing Sheets

FULL-FRAME ANCHORING SYSTEM FOR VEHICLE COLLISION REPAIR

TECHNICAL FIELD

This invention provides apparatus for clamping a vehicle's frame members and supporting the clamped vehicle in a fixed position above a support frame for collision repair. Each clamp assembly is independently rotatably adjustable with respect to two mutually perpendicular axes which are respectively perpendicular and parallel to the plane of the support frame. The base of each clamp assembly can thus be levelled with respect to the support frame before the assembly is secured to the support frame. This allows each clamp assembly to be clamped onto a vehicle frame member, irrespective of the frame member's orientation relative to the support frame.

BACKGROUND

U.S. Pat. No. 4,606,216 discloses a vehicle clamping and support apparatus having clamp assemblies which can be clamped over a vehicle's underbody pinch welds. The clamp assemblies can then be secured to a rigid framework to support the vehicle and facilitate collision repair work on the vehicle. So-called "full-frame" vehicles have frame members which must be clamped to support the vehicle while it undergoes collision repair. Unlike vehicle underbody pinch welds, such frame members are often curved in three dimensions—particularly in their forward regions—to accommodate vehicle engine and wheel placement, etc. Consequently, it is often necessary to clamp such frame members in orientations which are neither perpendicular nor parallel to the plane of the support surface above which the vehicle is supported for collision repair work. The clamp assemblies disclosed in U.S. Pat. No. 4,606,216 are not well suited to such use. This invention addresses that shortcoming.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
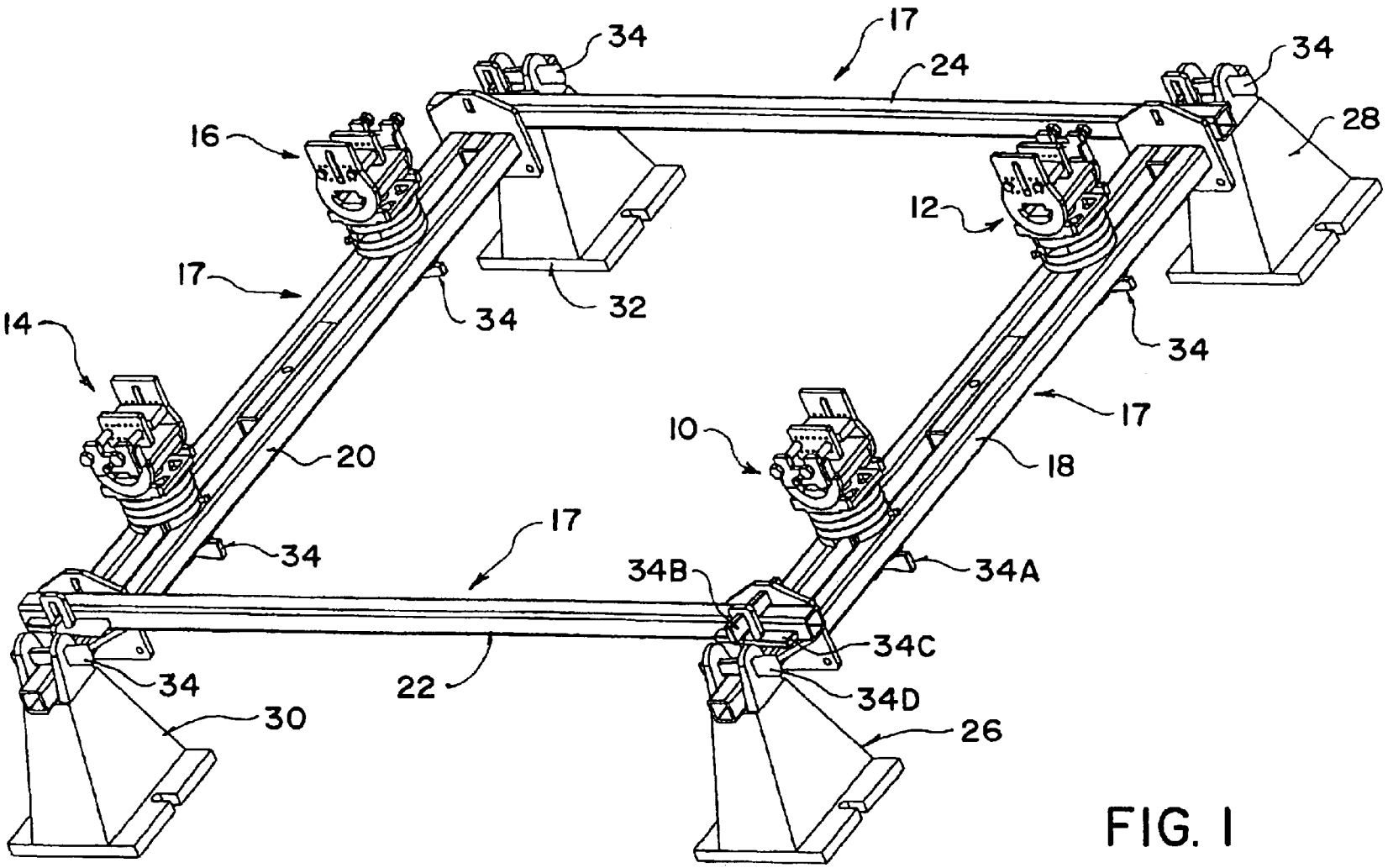
FIG. 1 is an oblique top isometric view of a full-frame anchoring system for vehicle collision repair in accordance with the invention.
Figure 2:
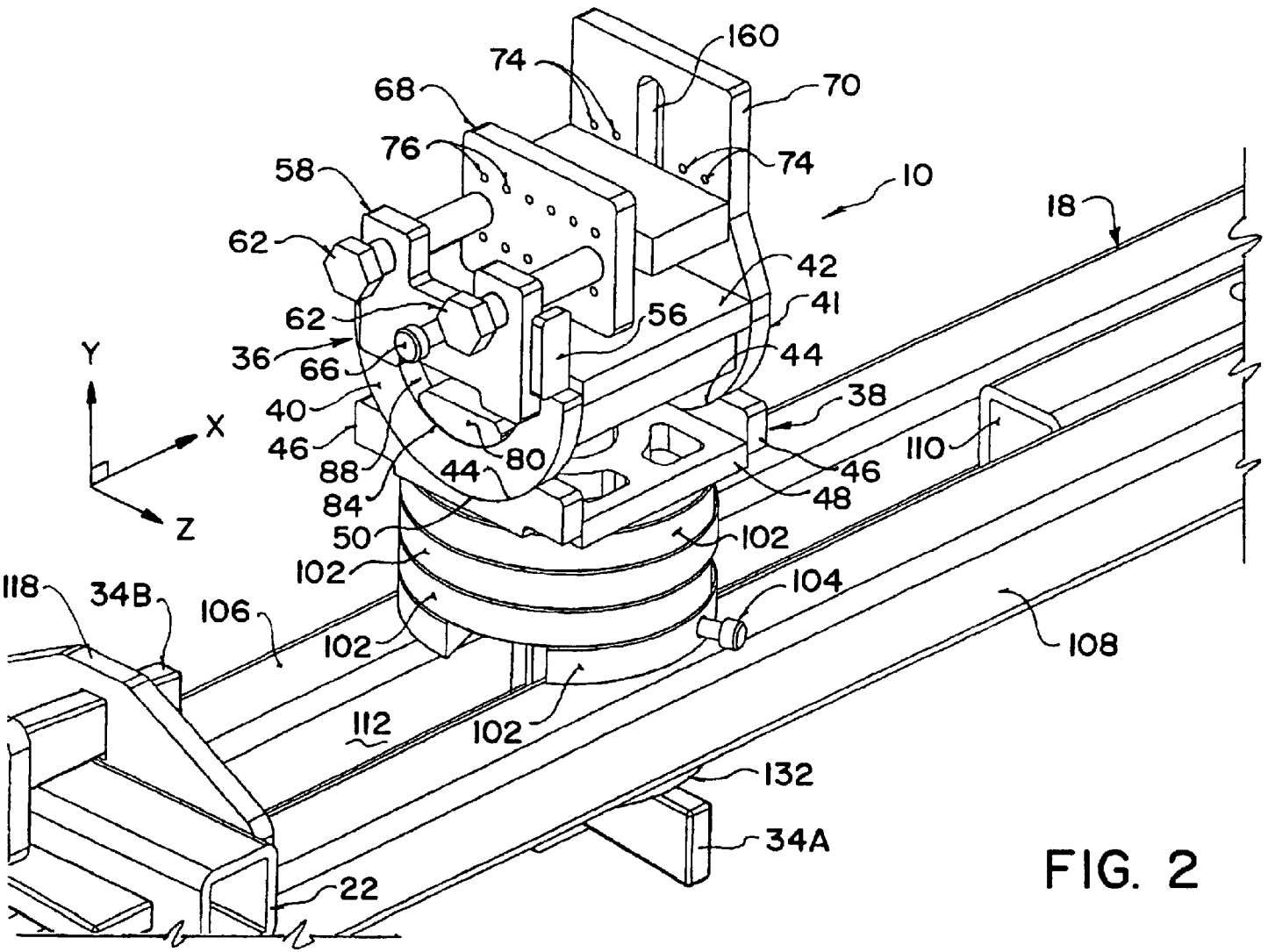
FIG. 2 is an enlarged oblique top isometric view of one of the four clamp assemblies depicted in FIG. 1.
Figure 3:
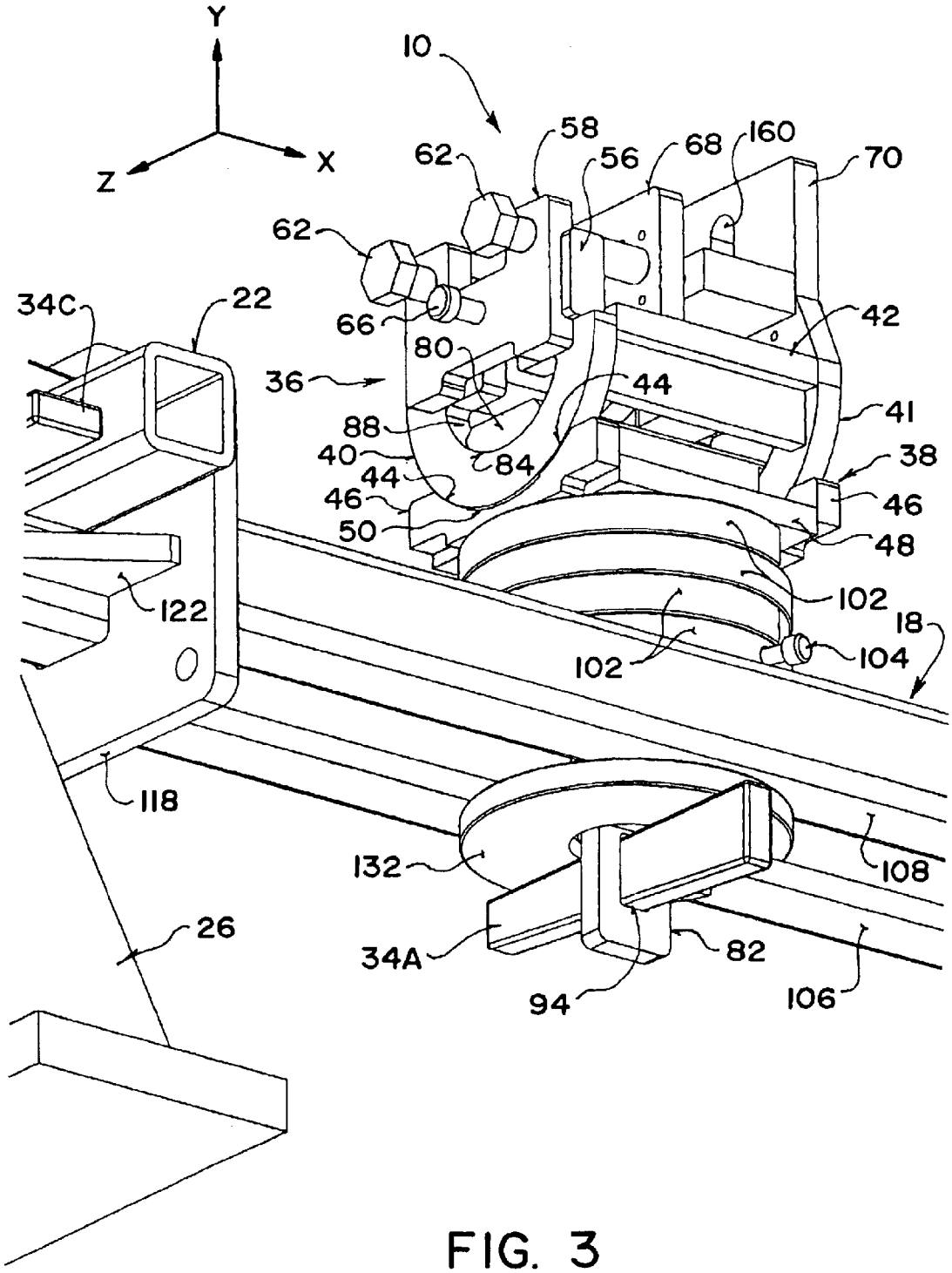
FIG. 3 is an enlarged oblique bottom isometric view of the FIG. 2 apparatus.

As shown in FIG. 1, the invention incorporates clamp assemblies 10, 12, 14, 16; a rectangular support frame 17 formed by interconnecting anchoring beams 18, 20 and anchoring side bars 22, 24 atop anchoring stands 26, 28, 30, 32; and, a plurality of wedges 34 which releasably interconnect the beams and the anchoring stands to form support frame 17 and which releasably fasten the clamp assemblies to support frame 17.

Clamp Assembly

Figure 22:
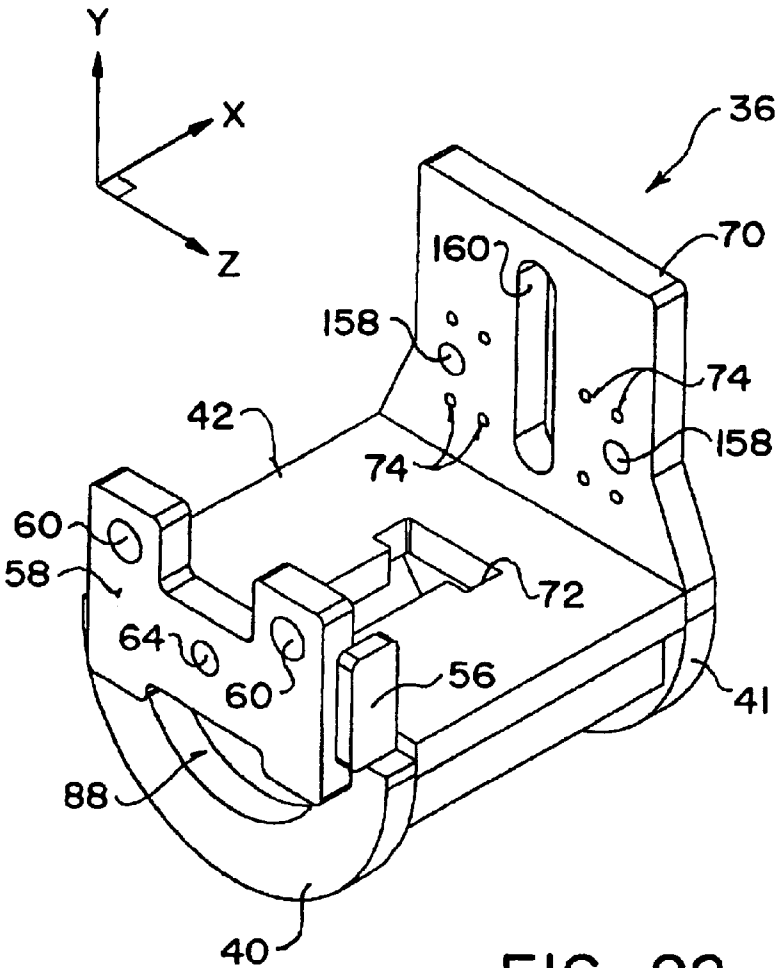
FIG. 22 is an oblique top isometric view of the clamp body portion of the FIG. 17 apparatus.
Figure 23:
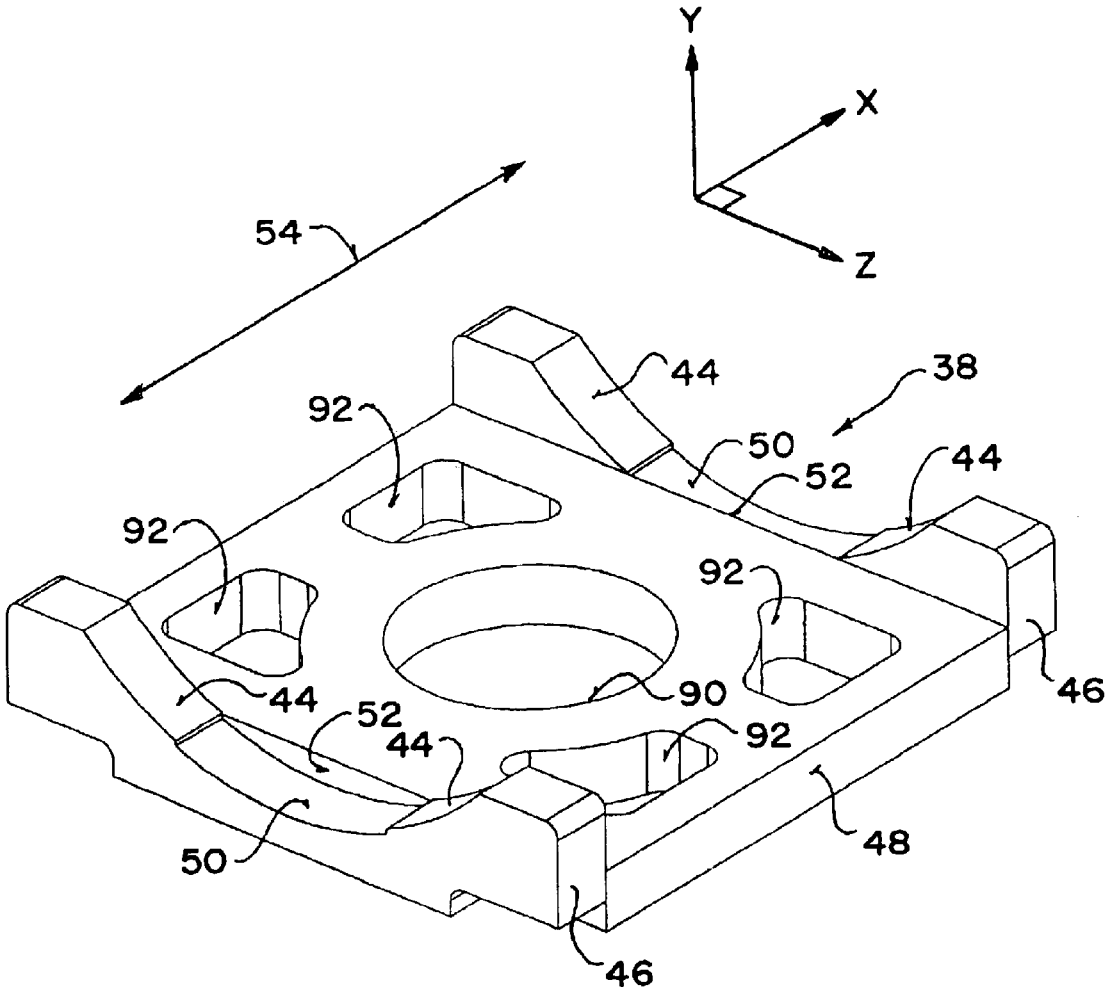
FIG. 23 is an oblique top isometric view of the base plate portion of the FIG. 17 apparatus.
Figure 25:
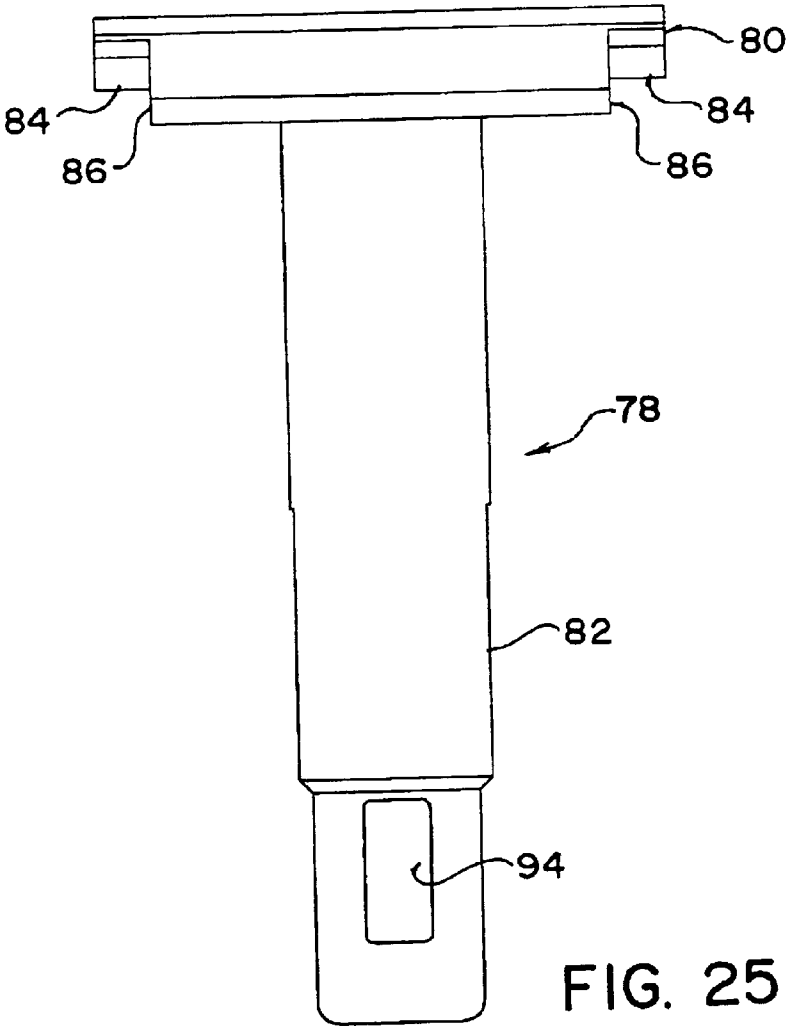
FIG. 25 is a front elevation view of the FIG. 24 apparatus.
Figure 24:
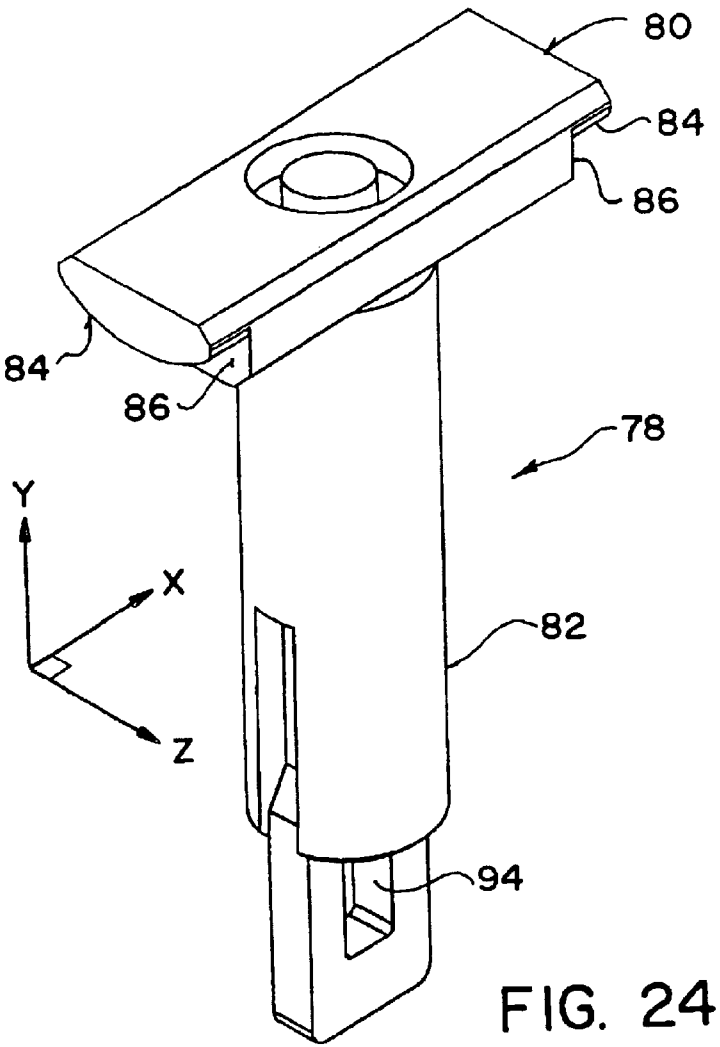
FIG. 24 is an oblique top isometric view of the pull-down assembly portion of the FIG. 17 apparatus.
Figure 27:
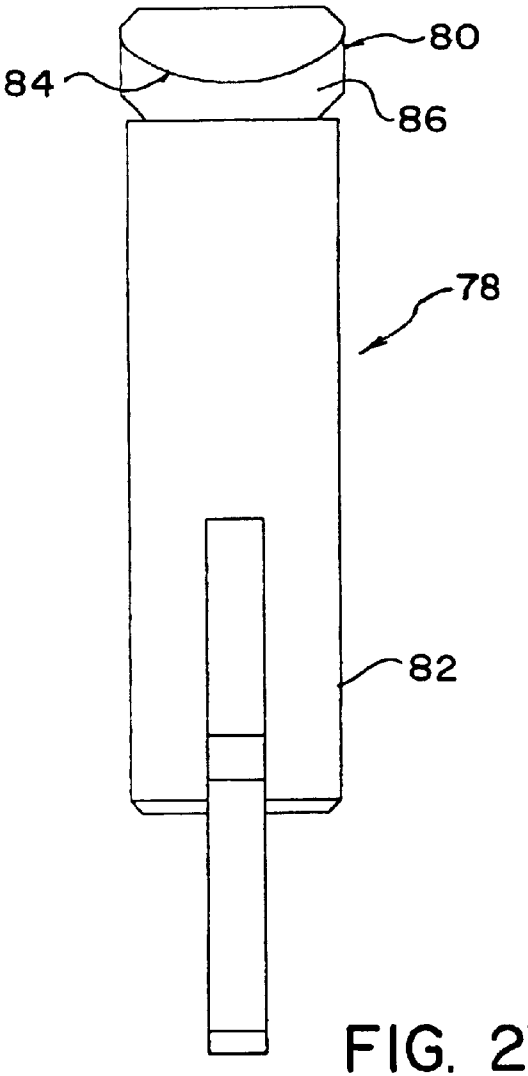
FIG. 27 is a side elevation view of the FIG. 24 apparatus.
Figure 26:
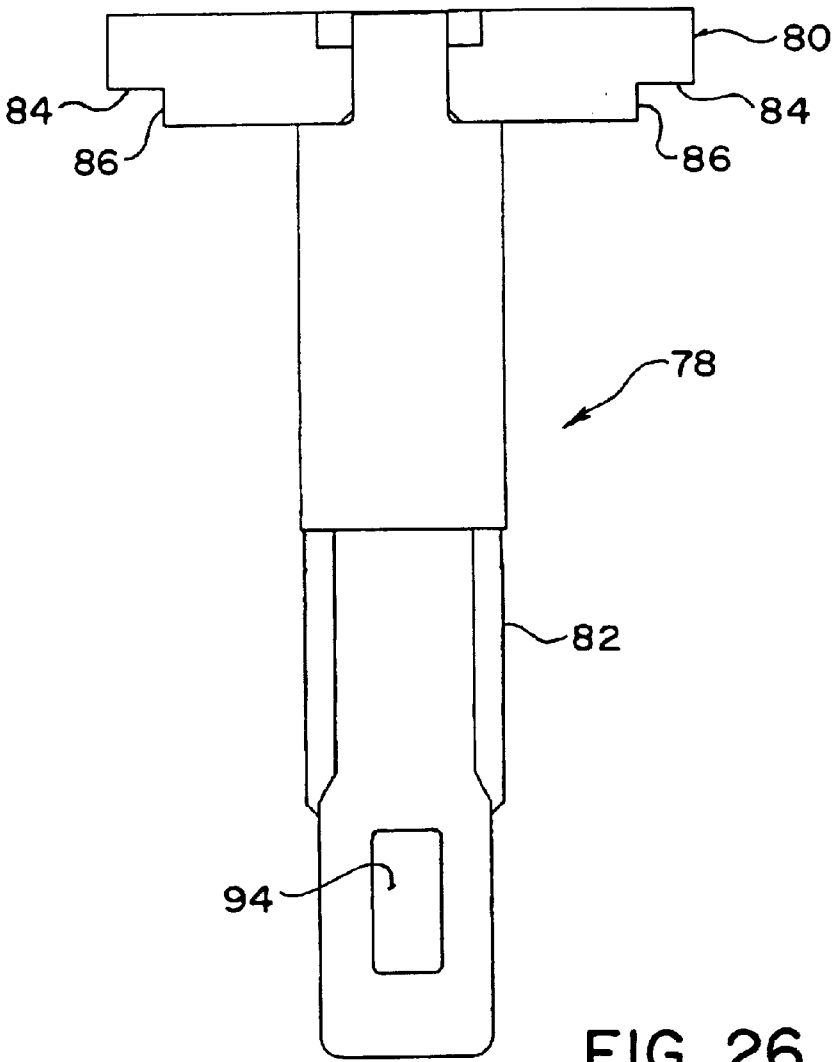
FIG. 26 is a sectional front elevation view of the FIG. 24 apparatus.

Clamp assemblies 10, 12, 14, 16 are identical. Accordingly only clamp assembly 10 is described, with reference to FIGS. 2–7 and 14–27. Clamp assembly 10 has a clamp body 36 (FIG. 22) which is rotatably supported on base plate 38 (FIG. 23). Clamp body 36 includes a pair of spaced, parallel, vertically extending plates 40, 41 which are fixed (preferably, welded) to the opposed ends of clamp body center plate 42. Plates 40, 41 have convex, coaxial semi-cylindrical lower ends which rotatably engage mating concave, coaxial semi-cylindrical faces 44 machined in the opposed vertically extending side plates 46 of base plate 38. The opposed ends of base plate center plate 48 are welded or otherwise firmly fixed to the inward vertical surfaces of side plates 46.

Figure 5:
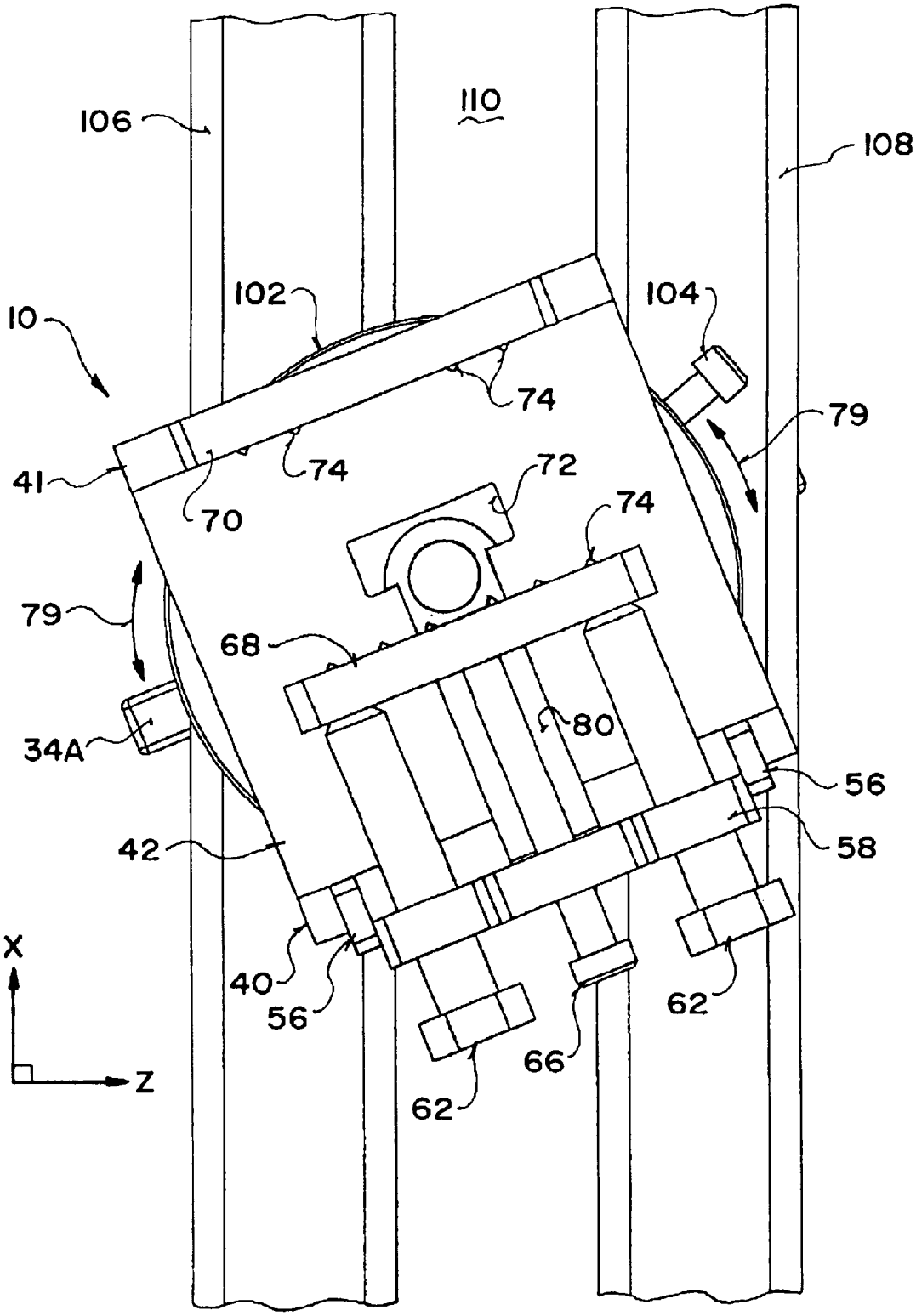
FIG. 5 is a top plan view of the FIG. 4 apparatus.
Figure 6:
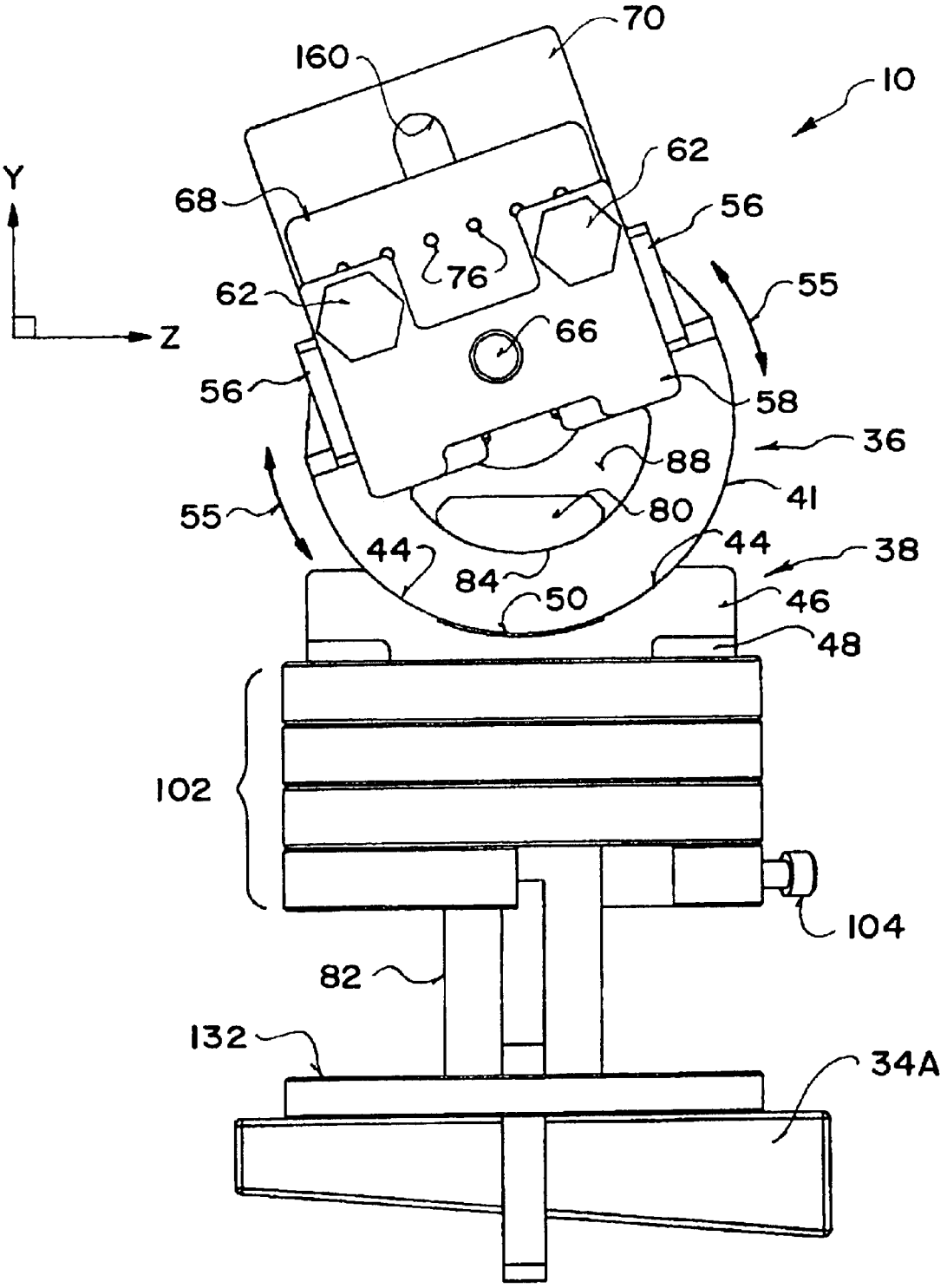
FIG. 6 is a side elevation view of the apparatus depicted in FIGS. 2 and 3, and shows the clamp assembly rotated with respect to a perpendicular axis.
Figure 7:
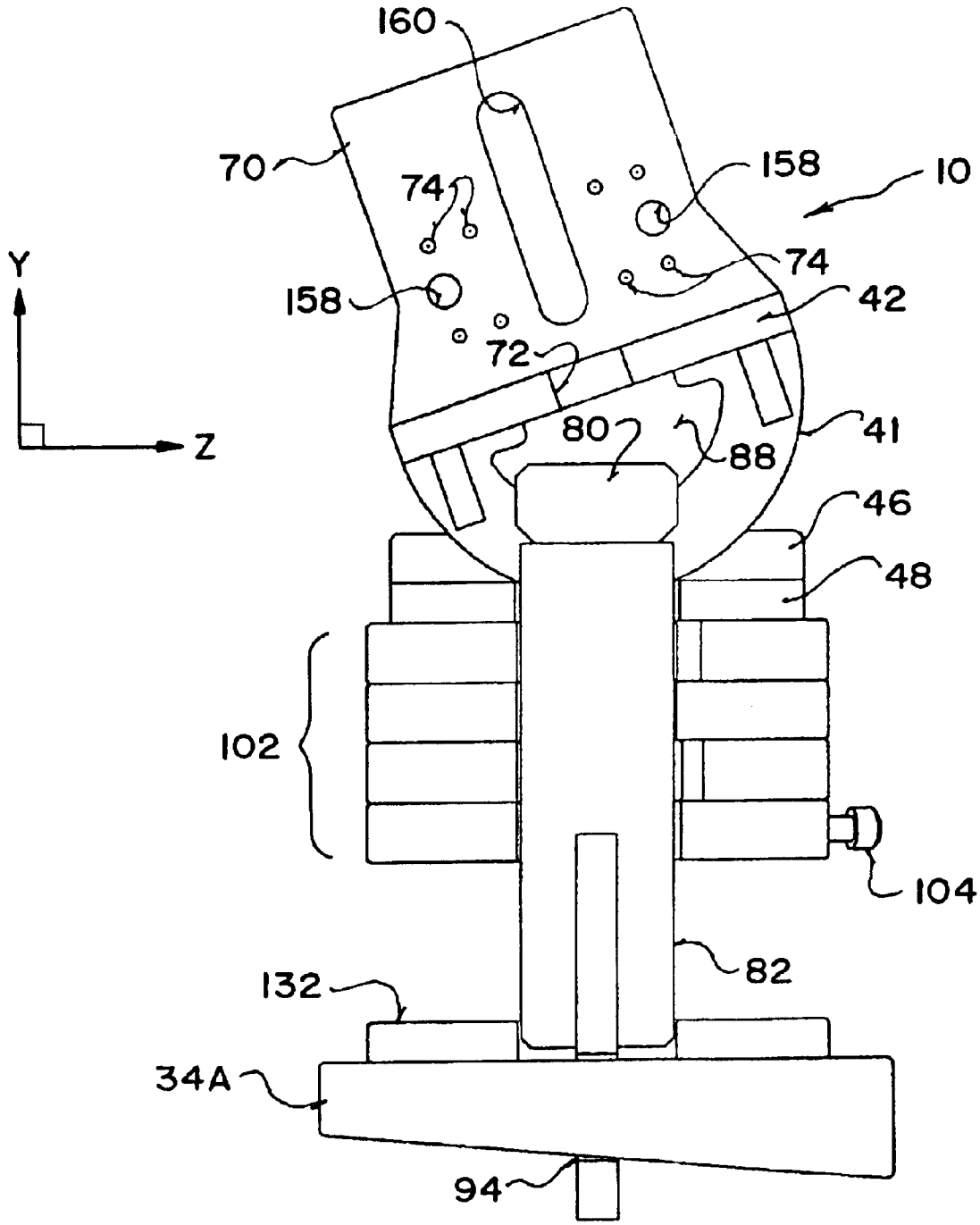
FIG. 7 is a sectional view of the FIG. 6 apparatus.

A central semi-cylindrical recess 50 is machined in the upper ends of each of side plates 46. This exposes opposed vertically extending sides 52 of center plate 48, which restrict movement in the directions indicated by double-headed arrow 54 when clamp body 36 is rotatably coupled atop base plate 38, preventing dislodgement of clamp body 36 from base plate 38. Clamp body 36 can be rotated relative to base plate 38 about a first axis corresponding to the axis of a notional cylinder co-cylindrical with the semi-cylindrical surfaces of the lower ends of plates 40, 41 and of mating side plate faces 44. That first axis is parallel to the X-Z plane indicated in FIGS. 2–4, 5, 17, 19 and 22–24, and substantially parallel to the plane of support frame 17. FIGS. 6 and 7 show clamp assembly 10 rotated with respect to the first axis. Arcuate, double-headed arrows 55 (FIG. 6) indicate the directions of rotation about the first axis.

Figure 17:
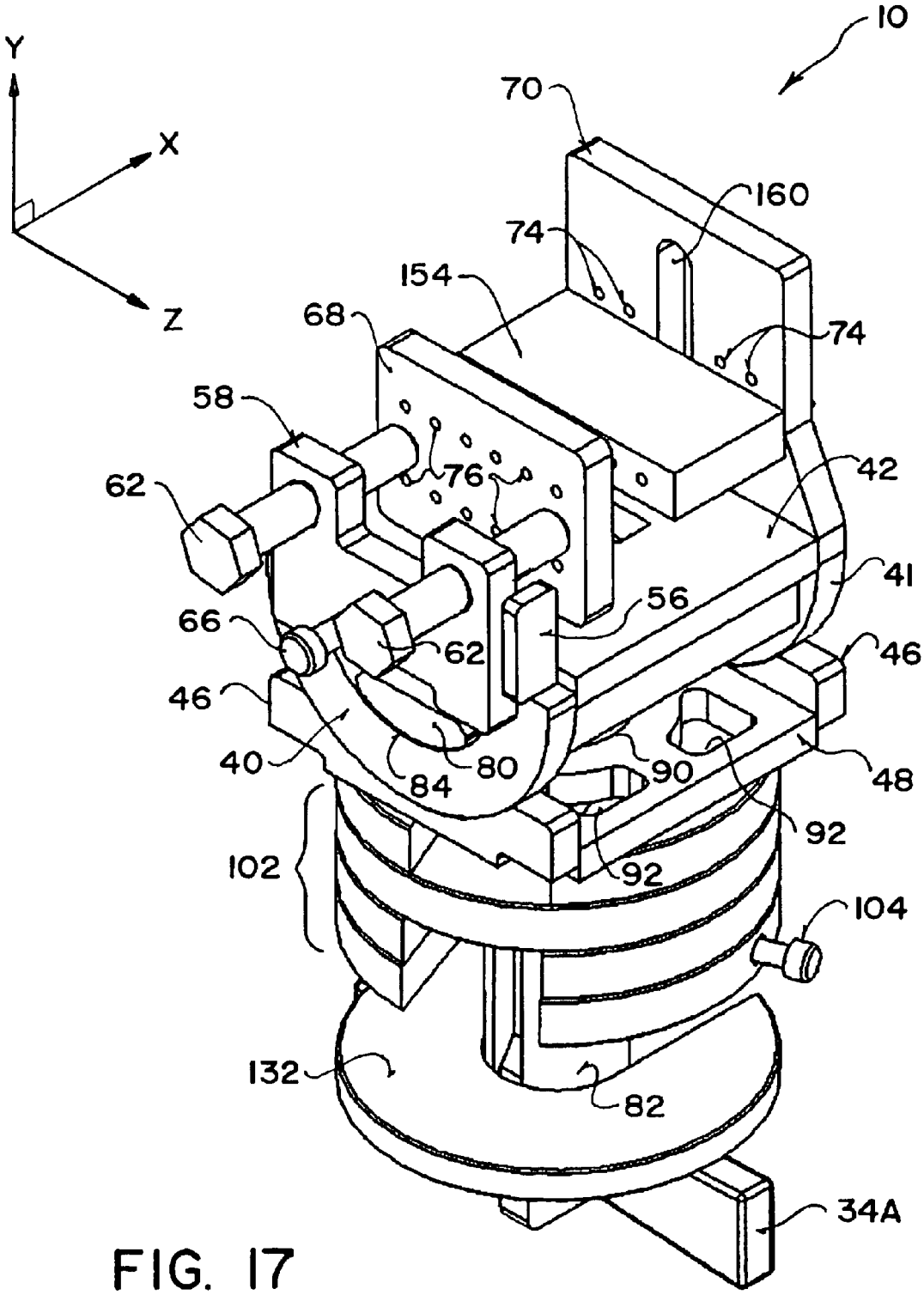
FIG. 17 is similar to FIG. 2 but omits details of the support frame.
Figure 18:
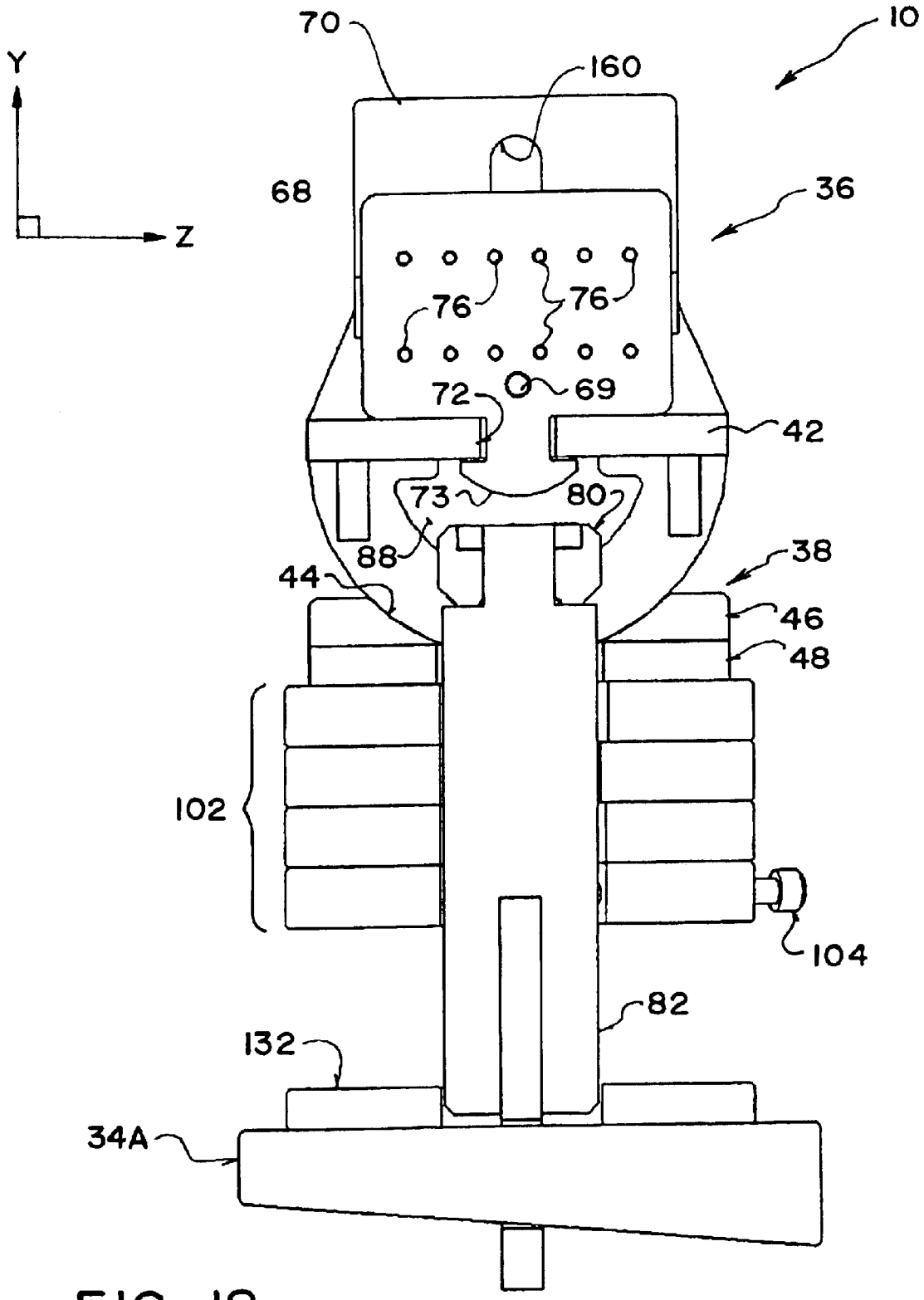
FIG. 18 is a sectional side elevation view of the FIG. 17 apparatus.
Figure 19:
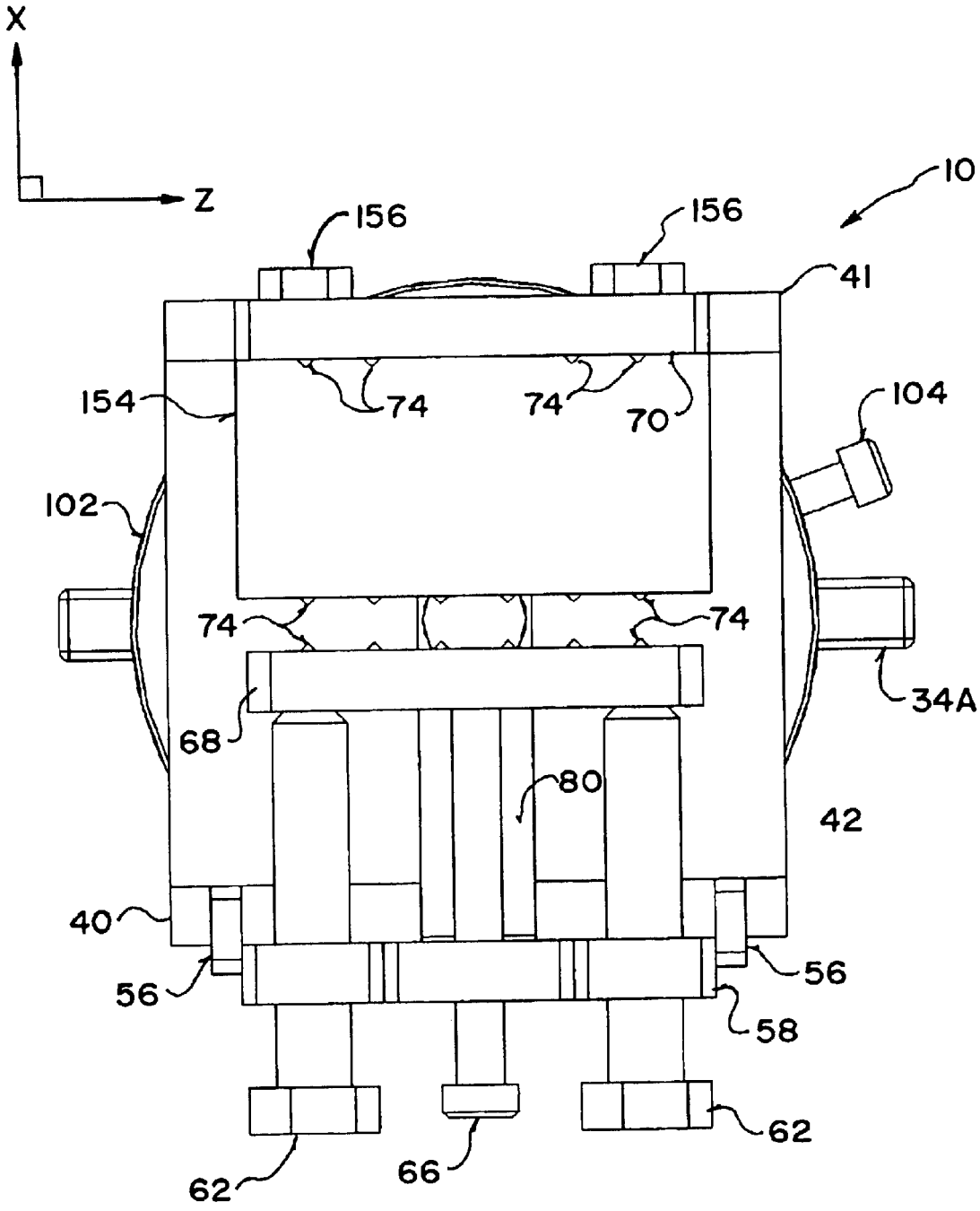
FIG. 19 is a top plan view of the FIG. 17 apparatus.
Figure 20:
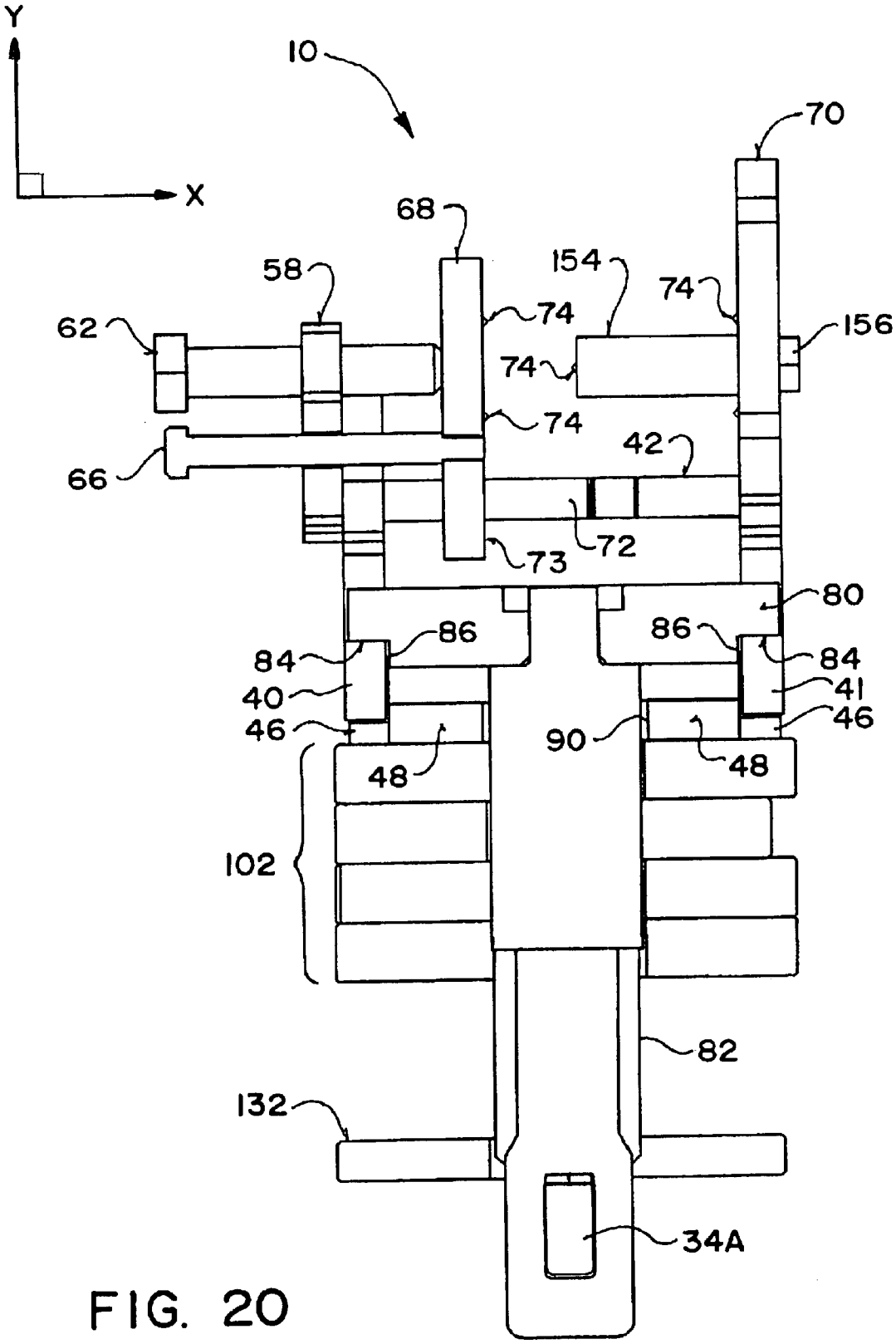
FIG. 20 is a sectional front elevation view of the FIG. 17 apparatus.

A pair of spaced, parallel, vertically extending flanges 56 (FIG. 22) are welded atop plate 40. The inward ends of flanges 56 are also welded to clamp body center plate 42. Vertically extending guide plate 58 is welded between flanges 56, parallel to plate 40. Threaded apertures 60 are machined in guide plate 58 to receive clamping bolts 62 (FIG. 17). Unthreaded aperture 64 is machined in guide plate 58 to receive guide (shoulder) bolt 66. Moveable clamp plate 68's aperture 69 (FIG. 18) fixedly receives the end of guide bolt 66. Clamping bolts 62 are tightened to advance moveable clamp plate 68 toward immoveable clamp backplate 70, which is formed by the upwardly projecting portion of plate 41. Moveable clamp plate 68 is retracted away from immoveable clamp backplate 70 by loosening clamping bolts 62 and pulling guide bolt 66 outwardly away from guide plate 58. A T-shaped guide slot 72 is machined in clamp body center plate 42. A mating, downwardly extending T-shaped protrusion 73 (FIGS. 18 and 20) is formed on the lower end of moveable clamp plate 68. The wide portion of T-shaped protrusion 73 is fitted through the wide end of T-shaped guide slot 72 before clamp plate 68 is fastened to guide bolt 66. The narrow portion of T-shaped protrusion 73 is thus constrained to move along the narrow channel portion of guide slot 72 as clamp plate 68 is advanced or retracted as aforesaid. The length of guide bolt 66 is selected to prevent displacement of T-shaped protrusion 73 to reach T-shaped guide slot 72 after guide bolt 66 is fastened to clamp plate 68, preventing dislodgment of clamp plate 68 from clamp body 36.

Figure 21:
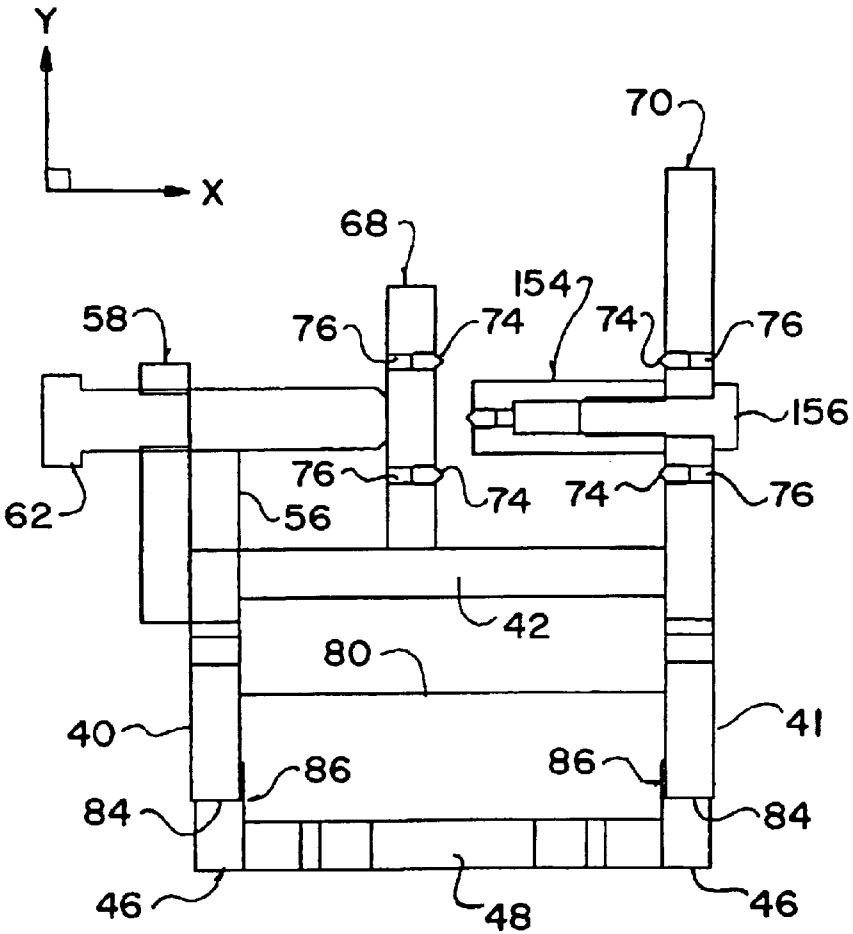
FIG. 21 is a sectional front elevation view of the clamp body portion of the FIG. 17 apparatus.

A plurality of replaceable teeth 74 are provided on the opposed inward faces of clamp plates 68, 70. As shown in FIG. 21, teeth 74 can be provided by forming a plurality of threaded apertures in each of clamp plates 68, 70 and then screwing a sharp-tipped set screw through each aperture 76 until the set screw's sharp tip protrudes through clamp plate 68 or 70, as illustrated. Teeth 74 assist in preventing dislodgment of a vehicle frame member clamped between plates 68, 70 as explained below.

Figure 4:
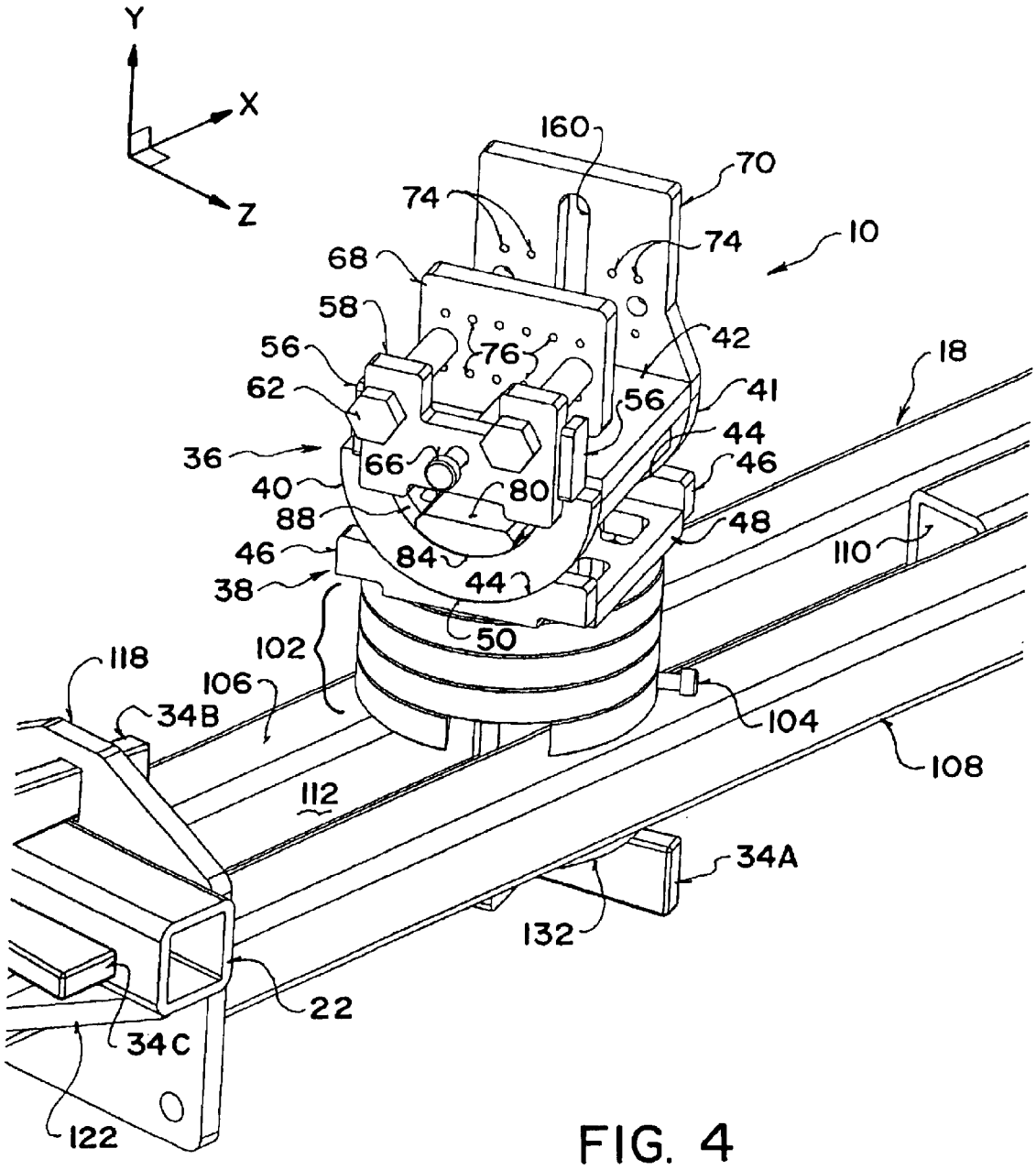
FIG. 4 is similar to FIG. 2, but shows the clamp assembly rotated with respect to a horizontal axis.

Pull-down assembly 78 (FIGS. 24–27) is installed on clamp body 36. Pull-down assembly 78 interconnects clamp body 36 and base plate 38, permitting their aforementioned rotation about the first axis and also permitting clamp assembly 10 to rotate about a second axis—parallel to the Y-Z plane indicated in FIGS. 2–4, 6–7, 18 and 22–24—before clamp body 36 is attached to a vehicle frame member as explained below. The second axis is substantially perpendicular to the plane of support frame 17 and substantially perpendicular to the first axis. FIGS. 4 and 5 show clamp assembly 10 rotated about the second axis. Arcuate, double-headed arrows 79 (FIG. 5) indicate the directions of rotation about the second axis.

Pull-down assembly 78 has a T-shape, formed by fixing horizontally extending locking bar 80 atop vertically extending shaft 82. The lower face portions 84 of locking bar 80's opposed outward ends are semi-cylindrically curved. An inward step 86 is also formed on the underside of each of locking bar 80's opposed ends. One of locking bar 80's stepped ends is inserted through semi-cylindrical aperture 88 (FIG. 22) formed in clamp body plate 40. Pull-down assembly 78 is then slidably moved toward the opposite clamp body plate 41 to insert the opposed stepped end of locking bar 80 into semi-cylindrical aperture 88 in plate 41. Pull-down assembly 78 is thus rotatably mounted on clamp body 36, with faces 84 rotationally engaging semi-cylindrical apertures 88. Base plate 38 can then be guided upwardly so that shaft 82 passes through base plate 38's central aperture 90 (FIG. 23). Additional apertures 92 may optionally be formed in base plate 38 to reduce its weight. A slot 94 is formed through the lower end of pull-down assembly 78's shaft 82.

Figure 14:
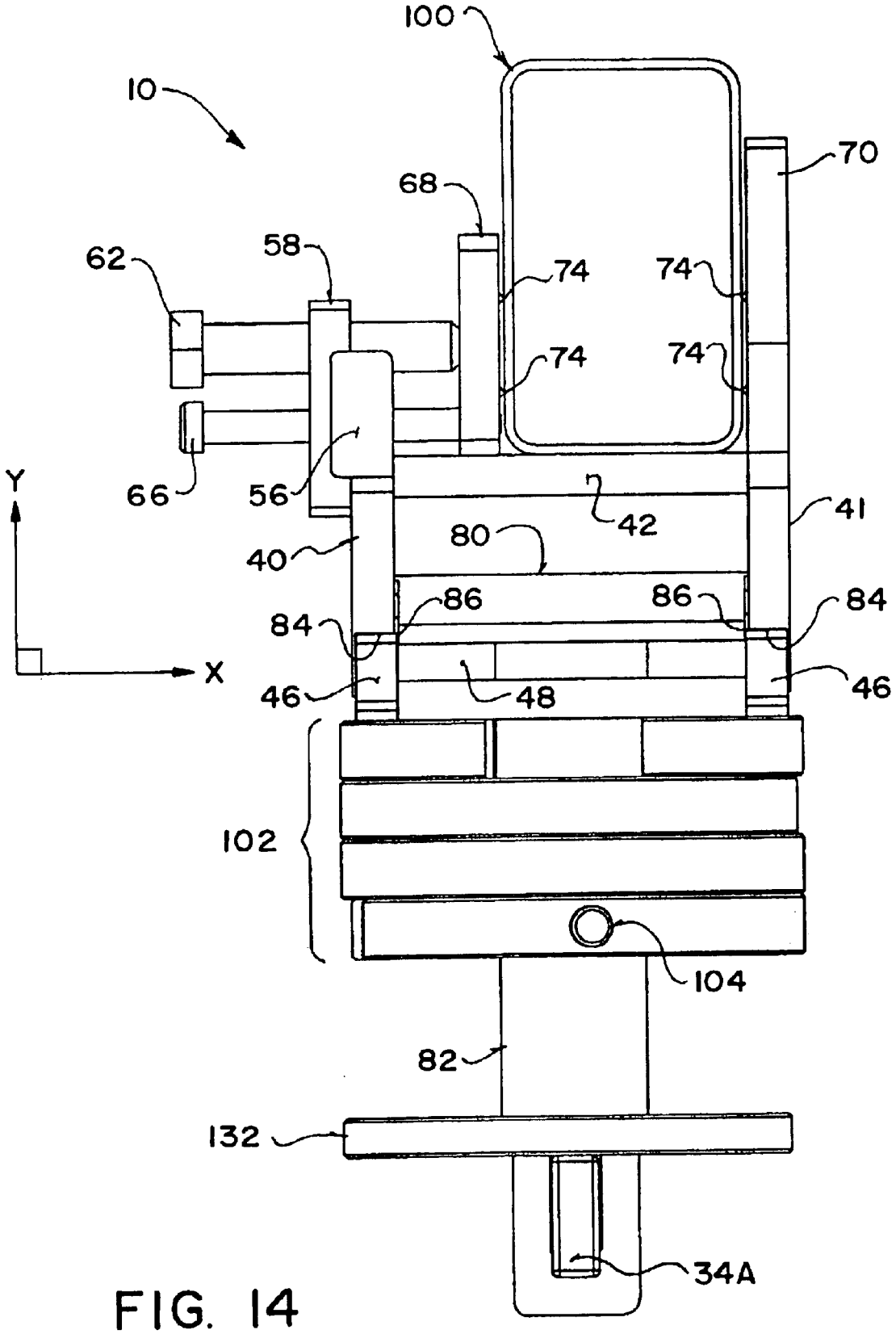
FIG. 14 is a front elevation view of a clamp assembly in accordance with the invention, clamping a sectionally depicted box section type vehicle frame member.
Figure 15:
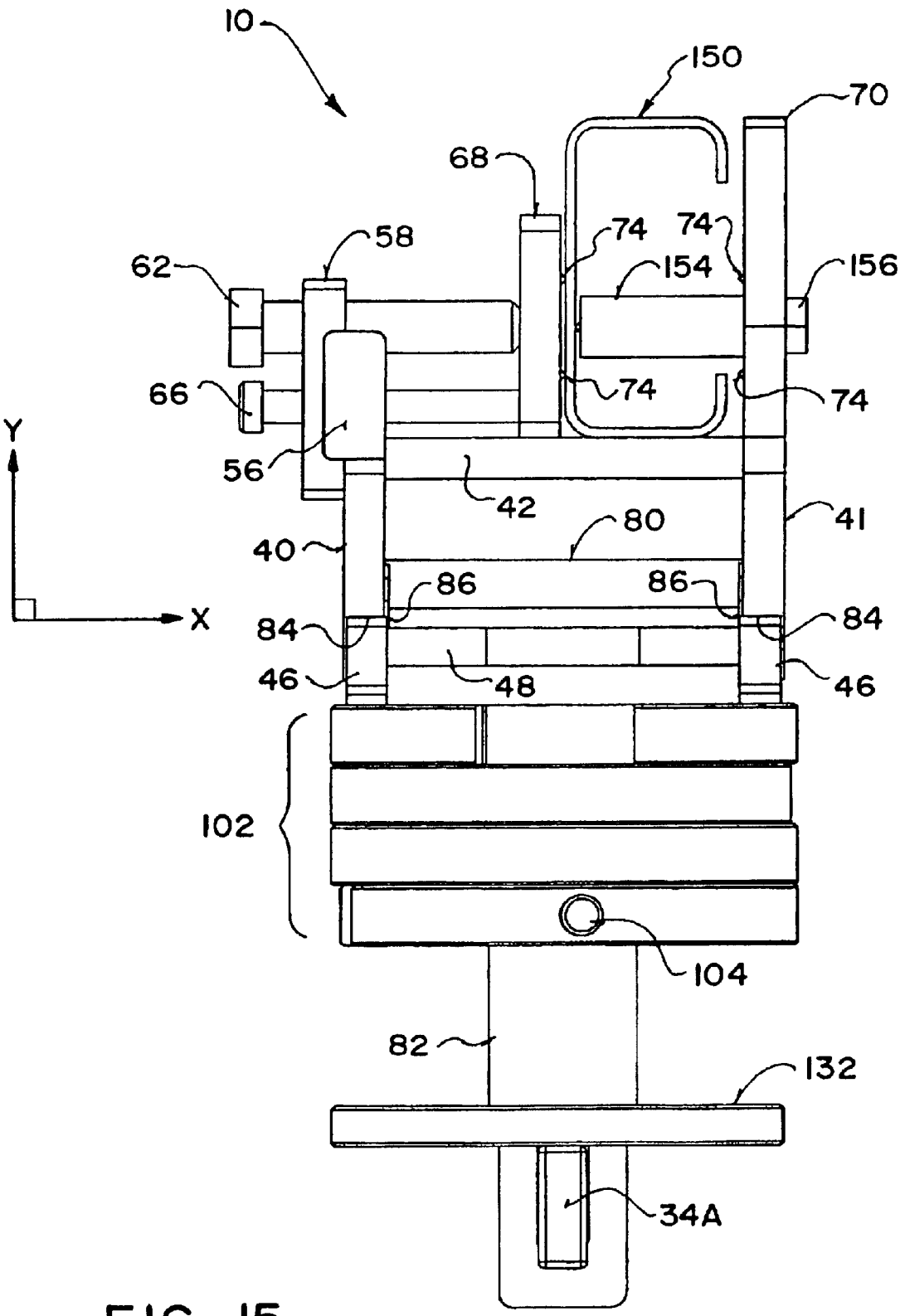
FIG. 15 is a front elevation view of a clamp assembly in accordance with the invention, clamping a sectionally depicted modified C-section type vehicle frame member.

In operation, the vehicle (not shown) is initially raised on jacks (not shown) or other convenient means. Bolts 62 are loosened to retract moveable clamp plate 68 sufficiently far away from clamp backplate 70 to allow plates 68, 70 to be positioned on opposite sides of box section type vehicle frame member 100 (FIG. 14). Clamping bolts 62 are then tightened to securely grip frame member 100 between clamp plates 68, 70. Base plate 38 is lifted over shaft 82 to rotatably mount clamp body 36 on base plate 38 as previously explained. One or more C-shaped spacers 102 are then slidably and rotatably fitted (stacked) on shaft 82, with the upper most spacer's top surface butted against the underside of base plate 38 and each succeeding spacer's upper surface butted against the underside of the upwardly adjacent spacer. The number of spacers 102 varies, depending on the height above support frame 17 at which clamp assembly 10 is fastened to the vehicle frame member. Lock bolt 104 is tightened through a threaded aperture provided in the lowermost spacer 102 to hold spacers 102 on shaft 82.

Clamp assemblies 12, 14, 16 are similarly attached to the vehicle's box section frame members at suitably spaced forward and rearward locations on both sides of the vehicle. More particularly, clamp assemblies 10, 12 are attached to the vehicle's frame members on opposite sides near one end of the vehicle; and, clamp assemblies 14, 16 are attached to the vehicle's frame members on opposite sides near the opposite end of the vehicle.

Support Frame

Figure 11:
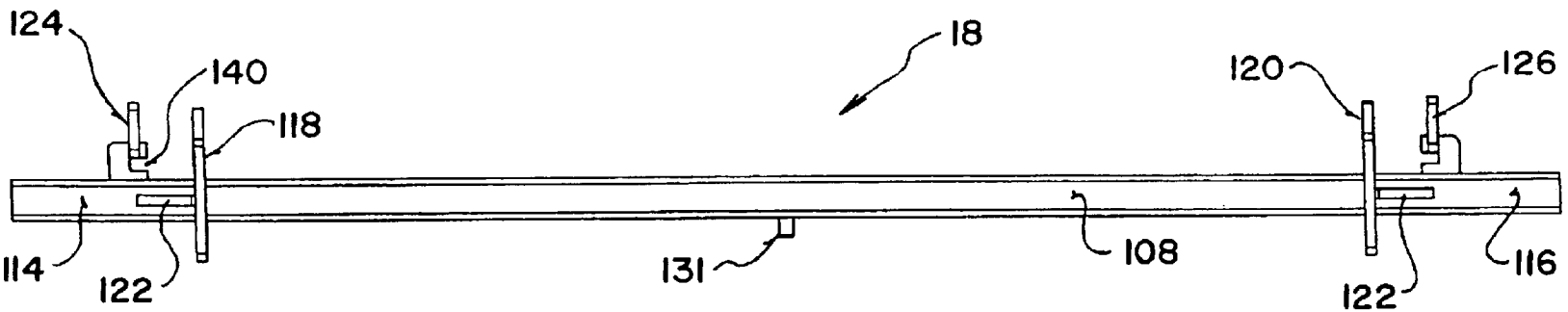
FIG. 11 is a front elevation view of the FIG. 9 apparatus.
Figure 12:
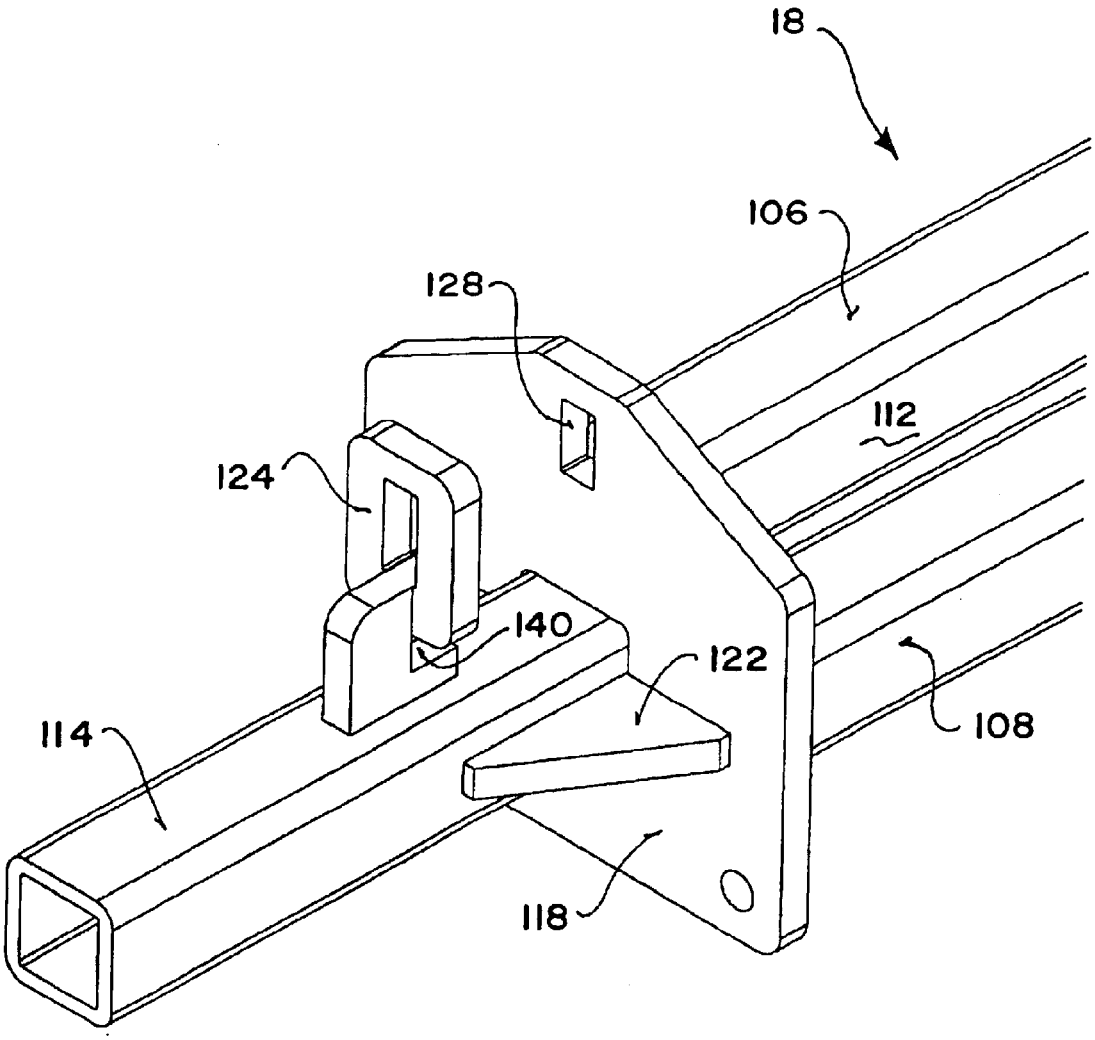
FIG. 12 is an oblique top isometric view of one end of the FIG. 9 apparatus.
Figure 13:
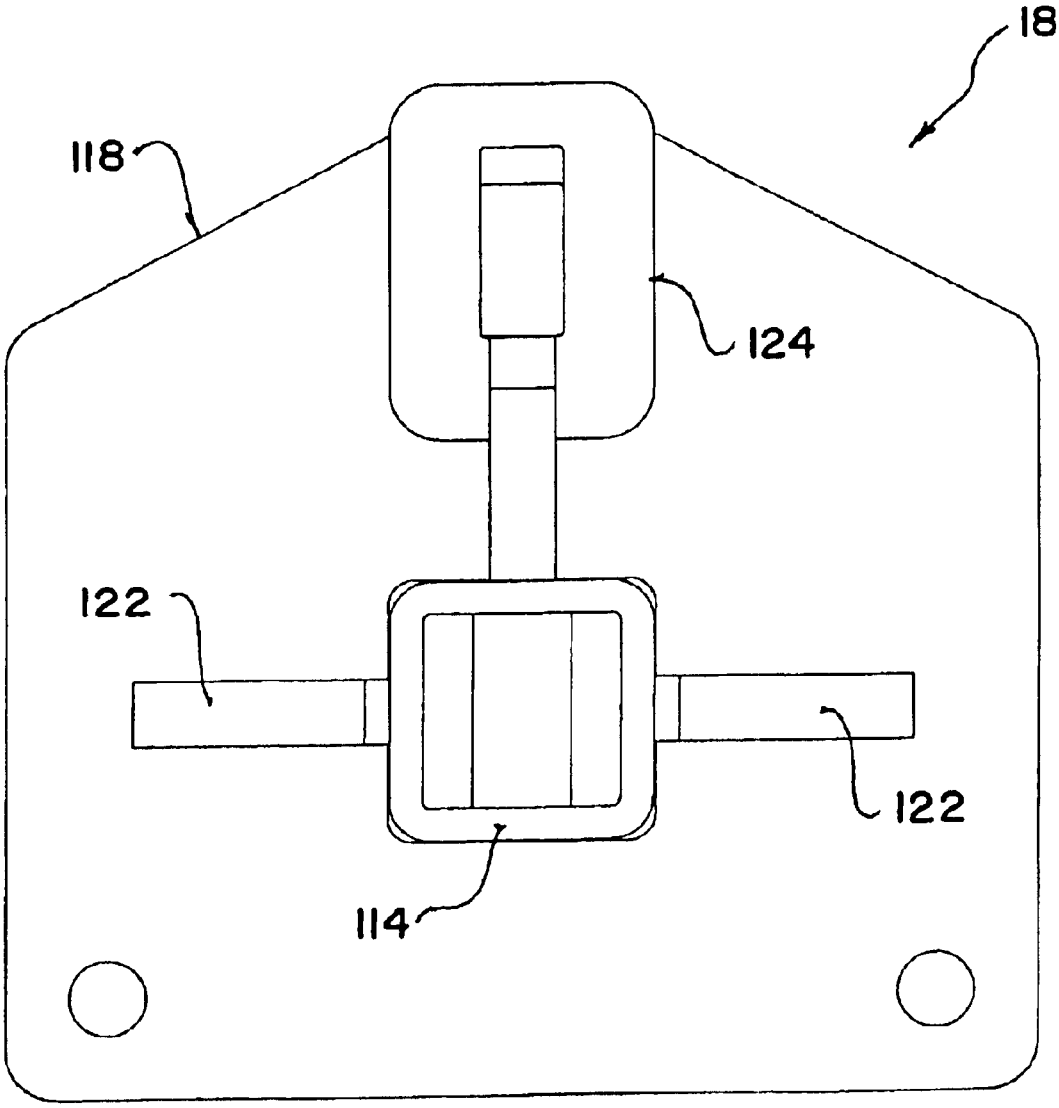
FIG. 13 is a side elevation view of the FIG. 9 apparatus.

Anchoring beams 18, 20 are identical. Accordingly only anchoring beam 18 is described, with reference to FIGS. 9–13. Anchoring beam 18 incorporates first and second longitudinally extending, parallel, spaced tubular beams 106, 108. Tubular center spacer 110 is fixed between beams 106, 108 midway between their opposed ends, defining a longitudinal aperture 112 between beams 106, 108 on each side of spacer 110. Tubular end spacers 114, 116 are fixed between and protrude longitudinally away from the opposed ends of beams 106, 108 respectively. Parallel, vertically extending end plates 118, 120 are fitted over end spacers 114, 116 respectively and fixed to the opposed ends of beams 106, 108 respectively. Gussets 122 are fixed between end spacers 114, 116 and end plates 118, 120 respectively to strengthen anchoring beam 18. Slotted eyelets 124, 126 are fixed atop end spacers 114, 116 respectively, outside end plates 118, 120. Apertures 128, 130 are provided in end plates 118, 120 respectively, in alignment with the apertures provided in each of eyelets 124, 126 respectively. Pin 131 (FIG. 11) is fixed through and protrudes beneath center spacer 110 for engagement within a mating recess in a typical shop hydraulic floor jack, to provide stable support for anchoring beam 18's central region.

After clamp assemblies 10, 12 are fastened to the vehicle's frame members as aforesaid, anchoring beam 18 is lifted and manouevred beneath clamp assemblies 10, 12, allowing the clamp assemblies' shafts 82 to protrude downwardly through apertures 112 on opposite sides of spacer 110. As is well known, the frame members of modern "full-frame" vehicles are not straight along their entire length. Such frame members are often curved in three dimensions—particularly in their forward regions—to accommodate vehicle engine and wheel placement, etc. Consequently, it is often necessary to clamp at least some of assemblies 10, 12, 14, 16 onto the vehicle's frame members-in orientations which are neither perpendicular nor parallel to the plane of the support surface above which the vehicle is supported (i.e. the plane of support frame 17 which is parallel to a notional plane defined by the depicted mutually perpendicular X and Z axes). Because each clamp assembly is independently rotatably adjustable with respect to the aforementioned first and second axes, the base plates 38 of each clamp assembly can be levelled with respect to support frame 17 before the assembly is attached to support frame 17 as explained below. This allows each clamp assembly to be clamped onto a vehicle frame member, irrespective of the frame member's orientation relative to support frame 17, without leaving gaps between clamp assemblies 10, 12, 14, 16 and support frame 17.

After anchoring beam 18 is positioned as aforesaid, one or more C-shaped spacers 132 (FIG. 3) are slidably positioned over shaft 82 and held against the underside of anchoring beam 18 while wedge 34A is driven through shaft 82's slot 94. The number of spacers 132 also varies, depending on the height above support frame 17 at which clamp assembly 10 is fastened to the vehicle frame member. As wedge 34A is driven through slot 94, pull-down assembly 78 is forced downwardly, thus forcing clamp body 36, base plate 38 and spacers 102 downwardly against the top of anchoring beam 18. Simultaneously, spacer 132 is forced upwardly against the underside of anchoring beam 18, thus firmly attaching clamp assembly 10 to anchoring beam 18. Clamp assembly 12 is similarly attached to anchoring beam 18 on the opposite side of spacer 110. Clamp assemblies 14, 16 are similarly attached to anchoring beam 20.

Figure 8:
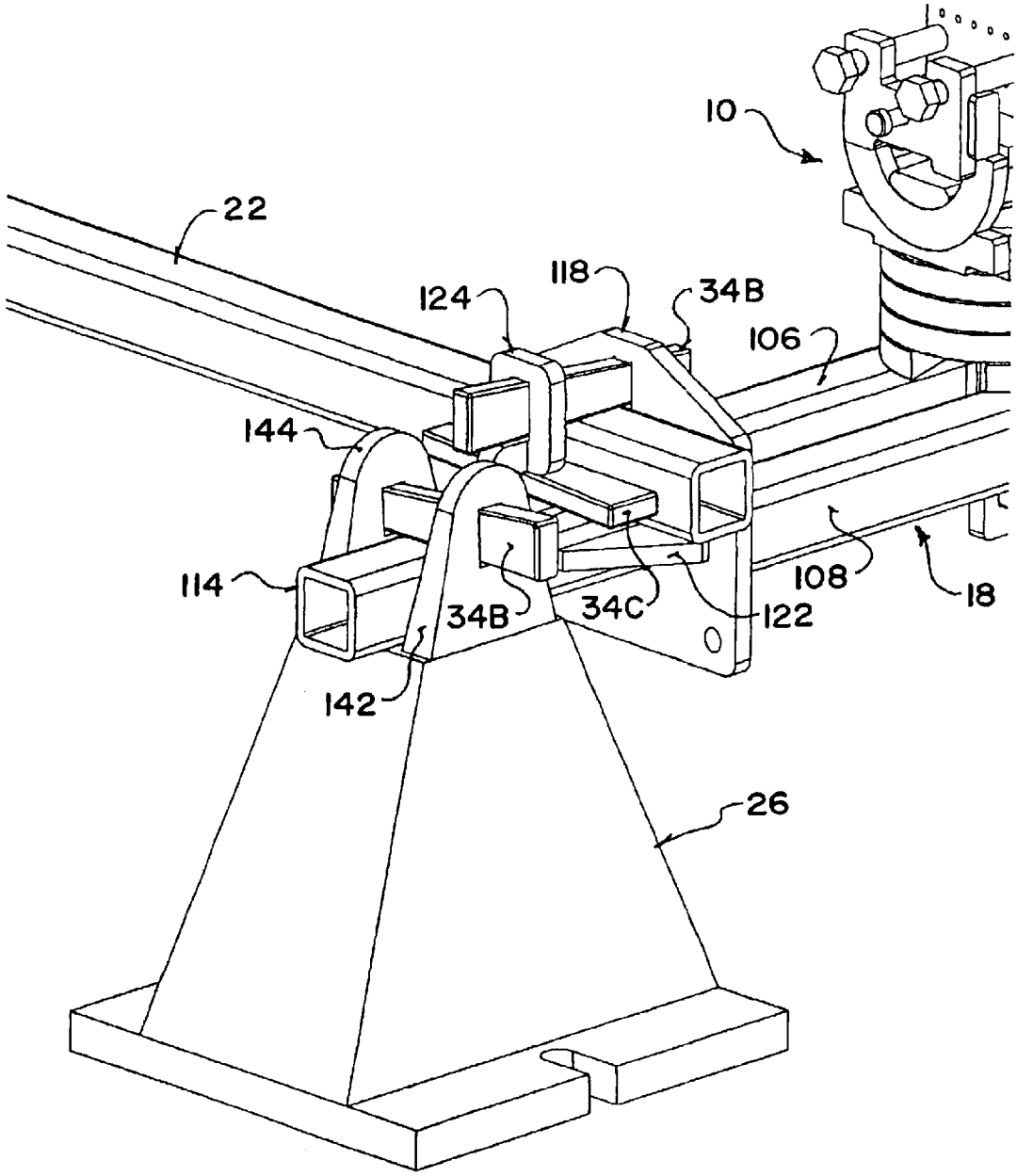
FIG. 8 is an enlarged oblique isometric view of one corner of the FIG. 1 apparatus.
Figure 9:
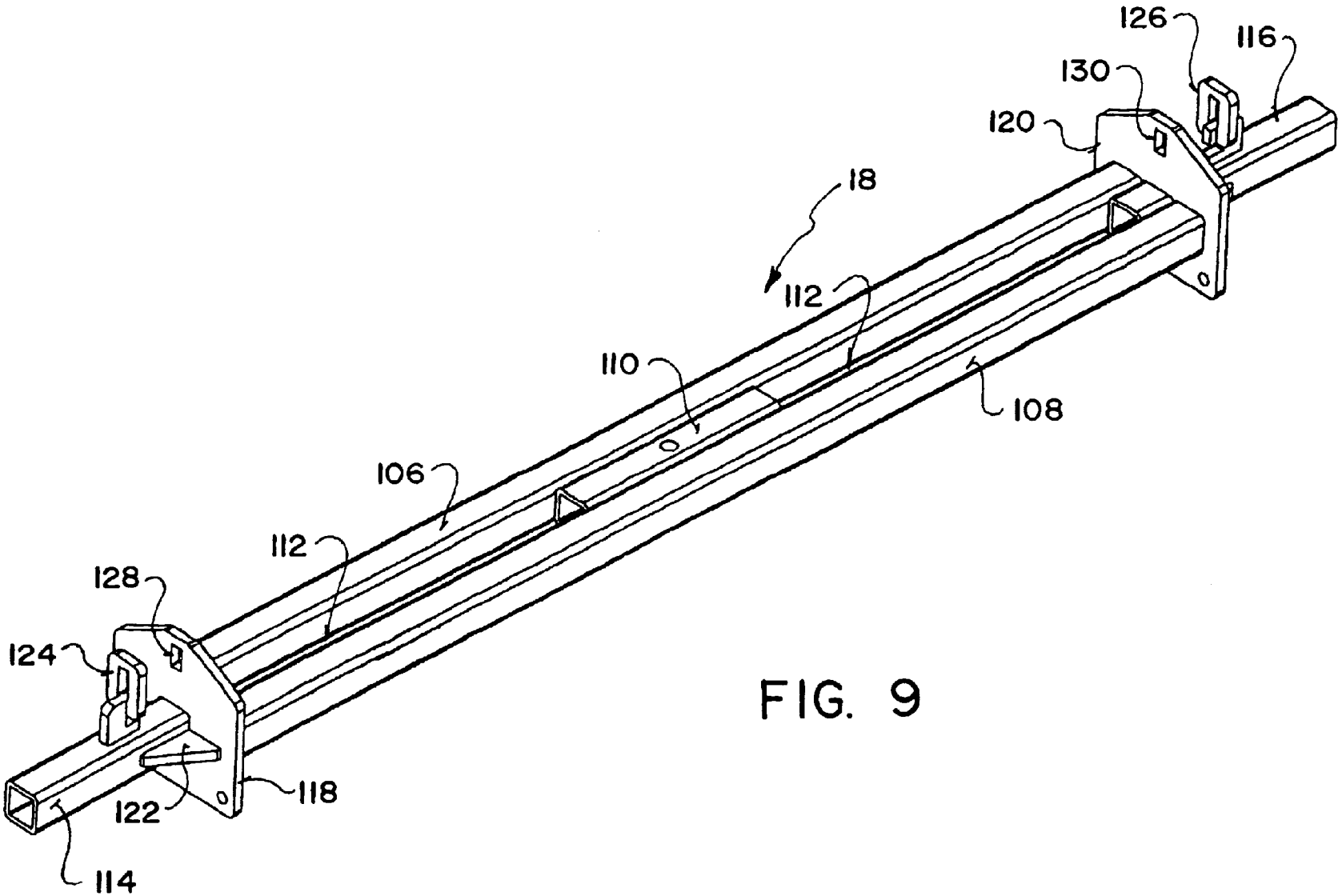
FIG. 9 is an oblique top isometric view of one of the two anchoring beams depicted in FIG. 1.
Figure 10:
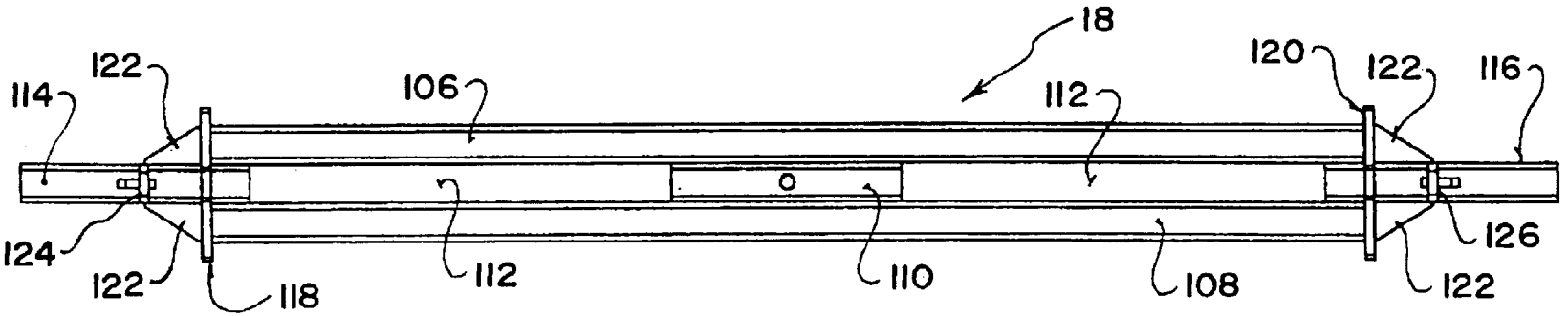
FIG. 10 is a top plan view of the FIG. 9 apparatus.

The opposed ends of tubular anchoring side bar 22 are then positioned atop the ends of anchoring beams 18, 20 on one side of the vehicle. More particularly, the opposed ends of anchoring side bar 22 are positioned between anchoring beam 18's end plate 118 and eyelet 124, at selected points of cross-over of anchoring side bar 22 and anchoring beams 18, 20. Wedge 34B (FIG. 8) is then driven through the aligned apertures in eyelet 124 and end plate 118, forcing anchoring side bar 22 downwardly against anchoring beam 18. Wedge 34C is driven through notch 140 (FIG. 11) formed beneath eyelet 124, forcing anchoring side bar 22 laterally against end plate 118. The opposite end of anchoring side bar 22 is similarly fastened atop anchoring beam 20 with another pair of wedges. The same procedure and four more wedges are used to securely fasten the opposed ends of anchoring side bar 24 to the opposite ends of anchoring beams 18, 20 respectively on the other side of the vehicle.

The flanged upper ends 142, 144 (FIG. 8) of anchoring stand 26 are then positioned on opposite sides of anchoring beam 18's protruding end spacer 114. Wedge 34D is then driven through aligned apertures provided in flanges 142, 144 to securely fasten anchoring beam 18 atop anchoring stand 26, which is then bolted or otherwise secured to a floor, floor rail, frame rack, platform or other suitable rigid supporting surface. This procedure is repeated at the opposite end of anchoring beam 18 to securely fasten protruding end spacer 116 atop anchoring stand 28; and, again repeated at each of anchoring beam 20's opposed ends to securely fasten them atop anchoring stands 30, 32 respectively. Anchoring stands 26, 28, 30, 32 are secured, as aforesaid, in the collision repair bay. The jacks or other means used to initially raise the vehicle are then disengaged and removed, leaving the vehicle securely clamped and supported atop support frame 17 and anchoring stands 26, 28, 30, 32. Collision damage to the vehicle is then repaired in conventional fashion. When the collision repair work is completed, the apparatus is easily disassembled by unsecuring the anchoring stands, knocking out the wedges which fasten support frame 17 to the anchoring stands and clamp assemblies, removing anchoring beams 18, 20 and anchoring side bars 22, 24 and detaching the clamp assemblies from the vehicle. It can thus be seen that the invention does not require permanent installation in a dedicated collision repair bay, as is required for larger, more cumbersome prior art vehicle clamping and support systems.

Figure 16:
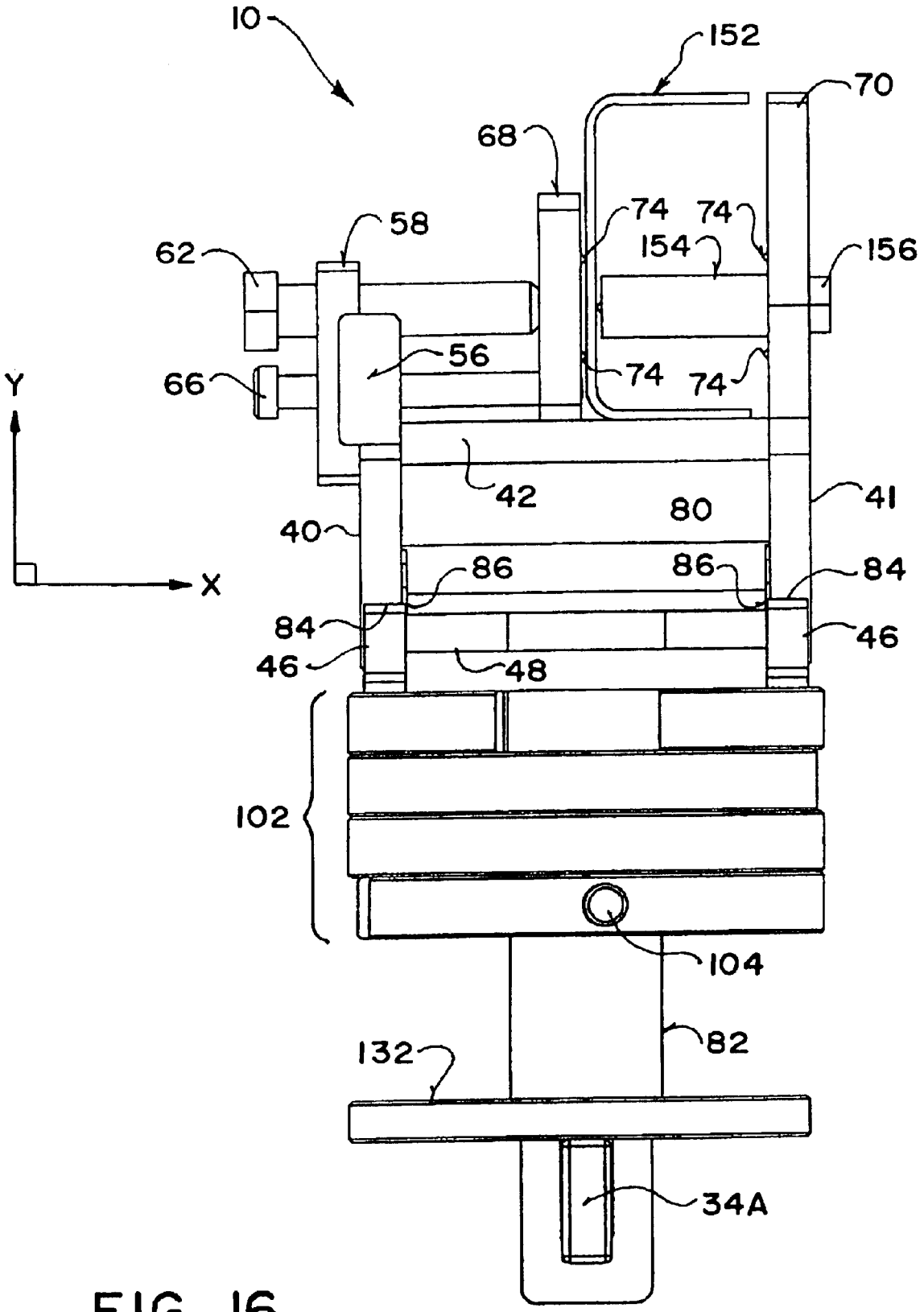
FIG. 16 is a front elevation view of a clamp assembly in accordance with the invention, clamping a sectionally depicted open C-section type vehicle frame member.

The invention can be adapted for use with modified C-section type vehicle frame members 150 (FIG. 15) or open C-section type vehicle frame members 152 (FIG. 16). This is achieved by means of C-section adapter plate 154 which is removably attached to the inward face of clamp backplate 70 by bolts 156 which extend through apertures 158 (FIG. 22). Additional teeth 74 are provided on the inwardly protruding end of C-section adapter plate 154 to clampingly engage C-section frame members 150 or 152 between. moveable clamp plate 68 and adapter plate 154 when clamping bolts 62 are tightened.

In some situations it may be possible to fasten one or more of clamp assemblies 10, 12, 14, 16 directly to the vehicle's frame members, without clamping them between plates 68, 70. This depends on the provision of suitably located threaded apertures, sockets, etc. in the vehicle's frame members. If such apertures, sockets, etc. are provided, one or more bolts, pins, etc. (not shown) can be passed through slot 160 in clamp backplate 70 and threaded, coupled, etc. into such apertures, sockets, etc.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A vehicle clamping device, comprising a clamp having an upper end for releasably clamping a vehicle frame member, and a lower end for releasably attaching a support frame, the clamp rotatable about a first axis substantially parallel to the support frame and rotatable about a second axis substantialty perpendicular to both the support frame and the first axis, the clamp upper end further comprising a clamp body rotatable couplable to a base plate, the clamp body and the base plate having mating semi-cylindrical surfaces co-cylindrical with a notional cylinder having a longitudinal axis coaxial with the first axis.

2. A vehicle clamping device as defined in claim 1, further comprising a pull-down assembly rotatably coupled between the clamp body and the base plate.

3. A vehicle clamping device as defined in claim 2, the pull-down assembly further comprising a locking bar fixed across and atop a shaft.

4. A vehicle clamping device as defined in claim 3, the locking bar having opposed, semi-cylindrical ends, the semi-cylindrical ends having semi-cylindrical surfaces co-cylindrical with a notional cylinder having a longitudinal axis coaxial with the first axis.

5. A vehicle clamping device as defined in claim 3, the locking bar having opposed, semi-cylindrical ends rotatably couplable within semi-cylindrical apertures in the clamp body, the semi-cylindrical ends and apertures having semi-cylindrical surfaces co-cylindrical with a notional cylinder having a longitudinal axis coaxial with the first axis.

6. A vehicle clamping device, comprising a clamp having an upper end for releasably clamping a vehicle frame member, and a lower end for releasably attaching a support frame, the clamp rotatable about a first axis substantially parallel to the support frame and rotatable about a second axis substantially perpendicular to both the support frame and the first axis, the clamp upper end further comprising a clamp body rotatable couplable to a base plate, further comprising a pull-down assembly rotatably coupled to the clamp body, through the base plate.

7. A vehicle clamping device as defined in claim 6, the pull-down assembly further comprising a locking bar fixed across and atop a shaft.

8. A vehicle clamping device as defined in claim 7, the locking bar having opposed, semi-cylindrical ends, the semi-cylindrical ends having semi-cylindrical surfaces co-cylindrical with a notional cylinder having a longitudinal axis coaxial with the first axis.

9. A vehicle clamping device as defined in claim 7, the locking bar having opposed, semi-cylindrical ends rotatably couplable within semi-cylindrical apertures in the clamp body, the semi-cylindrical ends and apertures having semi-cylindrical surfaces co-cylindrical with a notional cylinder having a longitudinal axis coaxial with the first axis.

10. A vehicle clamping device as defined in claim 7, further comprising at least one upper spacer slidably and rotatably mountable on the shaft, between the clamp lower end and the support frame.

11. A vehicle clamping device as defined in claim 7, further comprising at least one C-shaped spacer slidably and rotatably mountable on the shaft, between the clamp lower end and the support frame.

12. A vehicle clamping device as defined in claim 7, the shaft extending beneath the support frame when the clamp upper end is clamped to the vehicle frame member and when the pull-down assembly is coupled between the clamp body and the base plate.

13. A vehicle clamping device as defined in claim 12, further comprising at least one lower spacer slidably and rotatably mountable on the shaft, beneath the support frame.

14. A vehicle clamping device as defined in claim 13, further comprising a first wedge drivingly insertable through a slot in the shaft, beneath the lowermost lower spacer.

15. A vehicle clamping device as defined in claim 14, the support frame further comprising a pair of spaced, parallel anchoring beams and a pair of spaced, parallel anchoring side bars, the anchoring side bars extending perpendicularly across the anchoring beams.

16. A vehicle clamping device as defined in claim 15, one end of each anchoring beam releasably securable to one end of one of the anchoring side bars at a selectable point of cross-over of that one anchoring beam end and that end of that one anchoring side bar.

17. A vehicle clamping device as defined in claim 16, further comprising:

(a) a pair of apertures on the anchoring beam, spaced away from the point of cross-over; and, (b) a second wedge drivingly insertable through the pair of apertures on the anchoring beam.

18. A vehicle clamping device as defined in claim 16, further comprising a third wedge drivingly insertable between the anchoring side bar and a flange on the anchoring beam.

19. Vehicle clamping and support apparatus, comprising:

(a) a support frame comprising first and second anchoring side bars restectively positionable along first and second lateral undersides of a vehicle, and first and second anchoring beams respectively positionable along front and rear undersides of the vehicle, transverse to the first and second anchoring side bars;

(b) a first clamp having an upper end releasably clampable to one of the vehicle's frame members, and a lower end releasably attachable to the support frame, the first clamp rotatable about a first axis substantially parallel to the support frame and rotatable about a second axis substantially perpendicular to both the support frame and the first axis;

(c) a second clamp having an upper end releasable clampable to one of the vehicle's frame members, and a lower end releasably attachable to the support frame, the second clamp rotatable about a third axis substantially parallel to the support frame and rotatable about a fourth axis substantially perpendicular to both the support frame and the third axis;

(d) a third clamp having an upper end releasably clampable to one of the vehicle's frame members, and a lower end releasably attachable to the support frame, the third clamp rotatable about a fifth axis substantially parallel to the support frame and rotatable about a sixth axis substantially perpendicular to both the support frame and the fifth axis;

(e) a fourth clamp having an upper end releasably clampable to one of the vehicle's frame members, and a lower end releasably attachable to the support frame, the fourth clamp rotatable about a seventh axis substantially parallel to the support frame and rotatable about an eighth axis substantially perpendicular to both the support frame and the seventh axis;

the first, second, third and fourth clamps being separable from the support frame for clamping of the first, second, third and fourth clamps to the vehicle frame members before the first, second, third and fourth clamps are secured to the support frame;

one end of each anchoring beam being releasably securable to one end of one of the anchoring side bars at a selectable point of cross-over of that one anchoring beam end and that end of that one anchoring side bar;

wherein:

(i) each one of the first, second, third and fourth clamps' upper ends extends above the support frame and overlaps a top surface portion of the support frame;

(ii) each one of the first, second, third and fourth clamps' lower ends extends beneath the support frame;

the apparatus further comprising:

(f) a first wedge drivingly insertable through the first clamp's lower end against a bottom surface portion of the support frame adjacent to the first clamp;

(g) a second wedge drivingly insertable through the second clamp's lower end against a bottom surface portion of the support frame adjacent to the second clamp;

(h) a third wedge drivingly insertable through the third clamp's lower end against a bottom surface portion of the support frame adjacent to the third clamp; and, (i) a fourth wedge drivingly insertable through the fourth clamp's lower end against a bottom surface portion of the support frame adjacent to the fourth clamp.

20. Vehicle clamping and support apparatus as defined in claim 19, further comprising:

(a) a first pair of spaced, apertured flanges at one end of the first anchoring beam, one end of the first anchoring side bar positionable between the first pair of flanges, a fifth wedge drivingly insertable through the first pair of flanges over the one end of the first anchoring side bar;

(b) a second pair of spaced, apertured flanges at an opposite end of the first anchoring beam, one end of the second anchoring side bar positionable between the second pair of flanges, a sixth wedge drivingly insertable through the second pair of flanges over the one end of the second anchoring side bar;

(c) a third pair of spaced, apertured flanges at one end of the second anchoring beam, an opposite end of the first anchoring side bar positionable between the third pair of flanges, a seventh wedge drivingly insertable through the, third pair of flanges over the opposite end of the first anchoring side bar; and, (d) a fourth pair of spaced, apertured flanges at an opposite end of the second anchoring beam, an opposite end of the second anchoring side bar positionable between the fourth pair of flanges, an eighth wedge drivingly insertable through the fourth pair of flanges over the opposite end of the second anchoring side bar.

21. A vehicle clamping device as defined in claim 20, further comprising:

(a) a ninth wedge drivingly insertable between the one end of the first anchoring side bar and one flange of the first pair of flanges;

(b) a tenth wedge drivingly insertable between the one end of the second anchoring side bar and one flange of the second pair of flanges;

(c) an eleventh wedge drivingly insertable between the opposite end of the first anchoring side bar and one flange of the third pair of flanges; and, (d) a twelfth wedge drivingly insertable between the opposite end of the second anchoring side bar and one flange of the fourth pair of flanges.

22. A vehicle clamping device, comprising a clamp having an upper end for releasably clamping a vehicle frame member, and a lower end for releasably attaching a support frame, the clamp rotatable about a first axis substantially parallel to the support frame and rotatable about a second axis substantially perpendicular to both the support frame and the first axis, the clamp upper end further comprising a clamp body rotatably couplable to a base slate, the clamp body having a semi-cylindrical lower end and the base plate having a semi-cylindrical upper end, the semi-cylindrical ends having semi-cylindrical surfaces co-cylindrical with a notional cylinder having a longitudinal axis coaxial with the first axis.

23. A vehicle clamping device, comprising a clamp having an upper end for releasably clamping a vehicle frame member, and a lower end for releasably attaching a support frame, the clamp rotatable about a first axis substantially parallel to the support frame and rotatable about a second axis substantially perpendicular to both the support frame and the first axis, the clamp upper end further comprising a clamp body rotatably couplable to a base plate, the clamp body having opposed, convex, coaxial semi-cylindrical lower end portions; the base plate having opposed, concave, coaxial semi-cylindrical upper end portions, the semi-cylindrical portions having semi-cylindrical surfaces co-cylindrical with a notional cylinder having a longitudinal axis coaxial with the first axis.

* * * * *